US010385660B2

(12) United States Patent
Richards

(10) Patent No.: US 10,385,660 B2
(45) Date of Patent: Aug. 20, 2019

(54) GRAVEL PACK SEALING ASSEMBLY

(71) Applicant: HALLIBURTON ENERGY SERVICES, INC., Houston, TX (US)

(72) Inventor: William M. Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 374 days.

(21) Appl. No.: 15/304,369

(22) PCT Filed: Jun. 23, 2014

(86) PCT No.: PCT/US2014/043684

§ 371 (c)(1),
(2) Date: Oct. 14, 2016

(87) PCT Pub. No.: WO2015/199645

PCT Pub. Date: Dec. 30, 2015

(65) Prior Publication Data

US 2017/0037710 A1 Feb. 9, 2017

(51) Int. Cl.
*E21B 33/12* (2006.01)
*E21B 43/04* (2006.01)
(Continued)

(52) U.S. Cl.
CPC ..... *E21B 43/04* (2013.01); *E21B 12/06* (2013.01); *E21B 19/10* (2013.01); *E21B 33/12* (2013.01);
(Continued)

(58) Field of Classification Search
CPC ..... E21B 12/06; E21B 19/10; E21B 33/12; E21B 37/00; E21B 43/04; E21B 43/14; E21B 43/267
See application file for complete search history.

(56) References Cited

U.S. PATENT DOCUMENTS 8,215,406 B2 * 7/2012 Dale ..... E21B 43/04 166/369
8,403,062 B2 * 3/2013 Dale ..... E21B 43/04 166/369

(Continued)

FOREIGN PATENT DOCUMENTS

WO 2014011524 A1 1/2014

OTHER PUBLICATIONS

International Search Report and Written Opinion issued by the Korean Intellectual Property Office regarding International Patent Application No. PCT/US2014/043684 dated Mar. 23, 2015, 10 pages.

*Primary Examiner* — Daniel P Stephenson
(74) *Attorney, Agent, or Firm* — Haynes and Boone, LLP

(57) ABSTRACT

A completion method and assembly includes a packer extending along a pipe that is positioned in a wellbore to create an annulus between the pipe and the wellbore, the packer having a sealing element with first and second ends. A shunt tube is positioned adjacent the sealing element and extends from at least the first end to the second end of the sealing element to form a bypass through which a volume of proppant can flow. A fluid chamber is disposed to release a setting fluid into the shunt tube to mix with proppant therein and seal the shunt tube once proppant has flowed into the annulus. An injection assembly includes a fluid chamber configured to accommodate a fluid; a fluid control line fluidically coupled to the fluid chamber and the shunt tube; and an actuation device to force the fluid from the fluid chamber and into the shunt tube.

18 Claims, 18 Drawing Sheets

(51) Int. Cl.

| | |
|---|---|
| ***E21B 43/14*** | (2006.01) |
| ***E21B 43/267*** | (2006.01) |
| ***E21B 37/00*** | (2006.01) |
| ***E21B 12/06*** | (2006.01) |
| ***E21B 19/10*** | (2006.01) |

(52) U.S. Cl.
CPC ..... *E21B 37/00* (2013.01); *E21B 43/14* (2013.01); *E21B 43/267* (2013.01)

(56) References Cited

U.S. PATENT DOCUMENTS

| | | | | |
|---|---|---|---|---|
| 2002/0092649 | A1* | 7/2002 | Bixenman | E21B 43/04 166/278 |
| 2007/0044962 | A1 | 3/2007 | Tibbles | |
| 2010/0096119 | A1 | 4/2010 | Sevre et al. | |
| 2011/0132599 | A1 | 6/2011 | Xu | |
| 2013/0048280 | A1 | 2/2013 | Techentien et al. | |
| 2014/0014337 | A1* | 1/2014 | Stringfield | E21B 43/04 166/278 |
| 2014/0083689 | A1* | 3/2014 | Streich | E21B 34/063 166/250.15 |
| 2015/0345250 | A1* | 12/2015 | Murphree | E21B 33/138 166/292 |
| 2017/0037710 | A1* | 2/2017 | Richards | E21B 43/04 |

* cited by examiner

GRAVEL PACK SEALING ASSEMBLY

TECHNICAL FIELD

The present disclosure relates generally to well completion and production operations and, more specifically, to zonal isolation during gravel packing operations.

BACKGROUND

After a well is drilled and a target reservoir has been encountered, a completion and production operation are performed, which may include sand control processes to prevent formation sand, fines, and other particulates from entering production tubing along with a formation fluid. Typically, one or more sand screens may be installed along the formation fluid flow path between production tubing and the surrounding reservoir. Additionally, the annulus formed between the production tubing and the casing (if a cased hole) or the formation (if an open hole) may be packed with a relatively coarse sand or gravel during gravel packing operations to filter the sand from the formation fluid. This coarse sand or gravel also supports the borehole in uncased holes and prevents the formation from collapsing into the annulus.

Generally, gravel packing operations include placing a lower completion assembly downhole within the target reservoir. The lower completion assembly may include one or more screens along the production tubing that is disposed between packer assemblies. A packer assembly may be located on the "uphole" or "heel side" (the side of the screen closest to the heel of the well or the uphole end of the completion assembly), on the "downhole" or "toe side" (the side of the screen closest to the end or the toe of the well), or both. After the lower completion assembly is placed in the desired location downhole, the packer assemblies are set (e.g., expanding or swelling the packer) to define zones within the annulus. Each zone is then gravel packed separately and independently, typically using a service tool that is run downhole. The service tool opens a valve mechanism associated with a first zone to allow access from the tubing into the annulus associated with the first zone. A fluid slurry containing gravel is pumped through the valve mechanism to fill the annulus associated with the first zone while the fluid within the slurry returns through the screens. After the first zone is packed, the service tool is moved up to close the valve mechanism in the first zone and to open the valve mechanism in a second zone. Thus, each are placed in a pumping position.

In "fishhook" wells, which have uphill wellbore geometries, or wellbore geometries within the 120 to 130 degree deviation range, gravel packing operations that fill the annulus in the "toe to heel" direction or opposite direction from the normal operations. Reverse positioning associated with fishhook wells creates high friction forces and is problematic to establish the needed pumping positions.

The present disclosure is directed to a post gravel pack sealing assembly and methods that overcome one or more of the shortcomings in the prior art.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
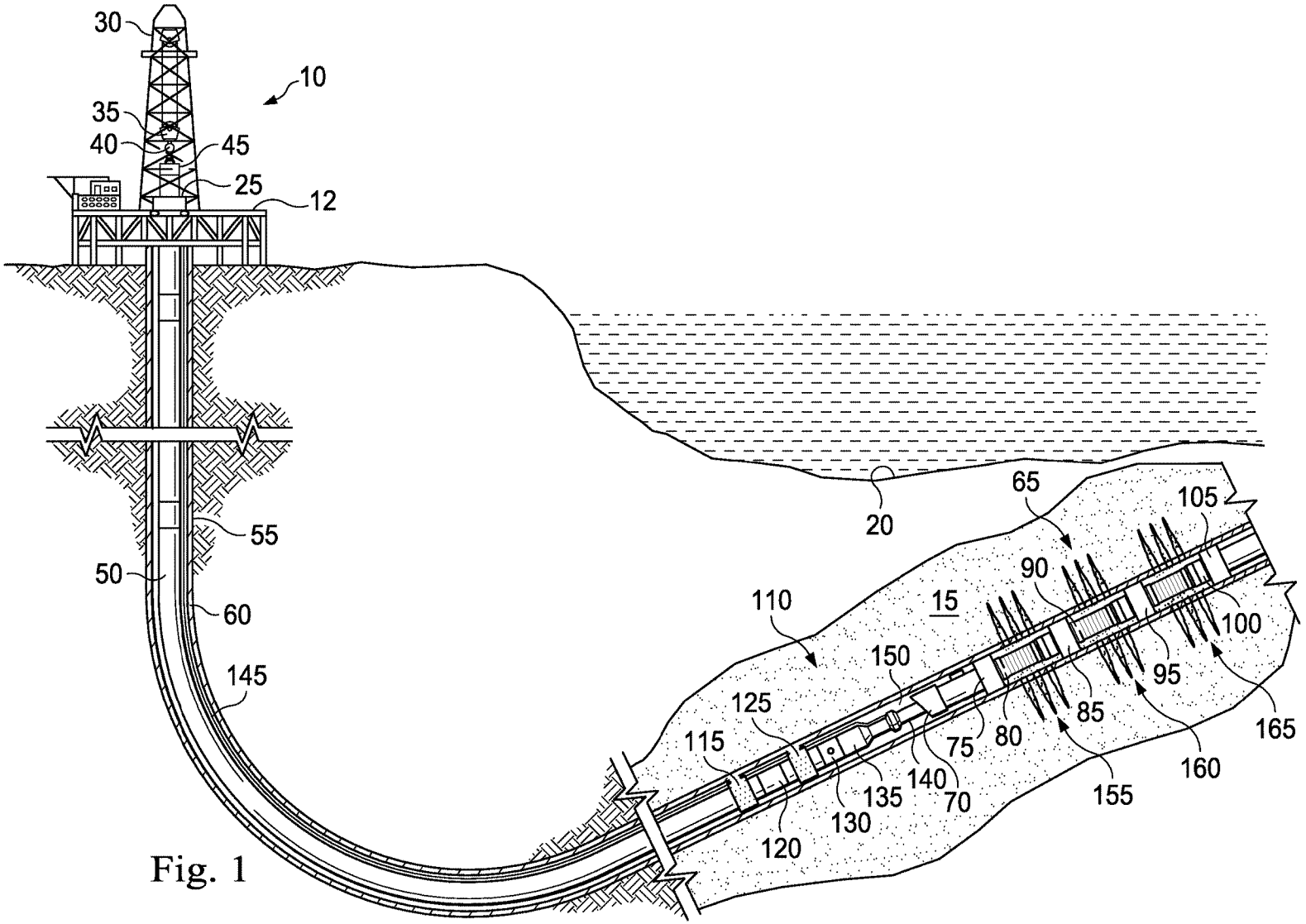
FIG. 1 is a schematic illustration of an oil and gas rig coupled to a lower completion assembly, the lower completion assembly including a packer assembly, according to an embodiment of the present disclosure.

Illustrative embodiments and related methods of the present disclosure are described below as they might be employed in a post gravel pack sealing assembly and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

Referring initially to FIG. 1, an upper completion assembly is installed in a "fishhook well," wherein a well includes an uphill wellbore geometry, or a wellbore geometry within a 120 to 130 degree deviation range. The well has a lower completion assembly disposed therein. More specifically, an oil or gas rig is schematically illustrated and generally designated 10. The rig 10 is positioned near a subterranean oil and gas formation 15 located below a sea floor 20. However, the subterranean oil and gas formation 15 may be located below any variety of geographical features. The rig 10 may generally include a hoisting apparatus 25, a derrick 30, a travel block 35, a hook 40, and a swivel 45 for raising and lowering pipe strings, such as a substantially tubular, axially extending tubing string 50.

A wellbore 55 extends through the various earth strata including the formation 15 and has a casing string 60 cemented therein. Disposed in a substantially upwardly-slanted portion of the wellbore 55 is a lower completion assembly 65 that may include various tools such as a latch subassembly 70, a packer assembly 75, a flow regulating system 80, a packer assembly 85, a flow regulating system 90, a packer assembly 95, a flow regulating system 100, and a packer assembly 105.

Disposed in the wellbore 55 at the lower end of the tubing string 50 is an upper completion assembly 110 that may include various tools such as a packer assembly 115, an expansion joint 120, a packer assembly 125, a fluid flow control module 130, and an anchor assembly 135. The upper completion assembly 110 may also include a latch subassembly 140 that couples to the latch subassembly 70. One or more communication cables such as an electric cable 145 that passes through the packers 115 and 125 may be provided and extend from the upper completion assembly 110 to the surface in an annulus 150 between the tubing string 50 and the casing 60. However, the annulus 150 maybe formed between the tubing string 50 and an interior surface of the wellbore 55 when the wellbore 55 is an open hole wellbore. In one or more embodiments, the packer assembly 85 fluidically isolates the annulus 150 within a first zone 155 of the well from the annulus 150 within a second zone 160 of the well. Additionally, the packer assembly 95 fluidically isolates the annulus 150 within the second zone 160 of the well from the annulus 150 within a third zone 165 of the well.

Even though FIG. 1 depicts an upwardly-slanted wellbore, or a "fishhook" wellbore, it should be understood by those skilled in the art that the apparatus according to the present disclosure is equally well suited for use in wellbores having other orientations including vertical wellbores, horizontal wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the uphole direction being toward the top of the corresponding figure and the downhole direction being toward the bottom of the corresponding figure, the uphole direction being toward the left of the corresponding figure and the downhole direction being toward the right of the corresponding figure, the uphole direction being toward the surface or the heel of the well, the downhole direction being toward the toe of the well. Also, even though FIG. 1 depicts an onshore operation, it should be understood by those skilled in the art that the apparatus according to the present disclosure is equally well suited for use in offshore operations. Further, even though FIG. 1 depicts a cased hole completion, it should be understood by those skilled in the art that the apparatus according to the present disclosure is equally well suited for use in open hole completions.

Figure 2:
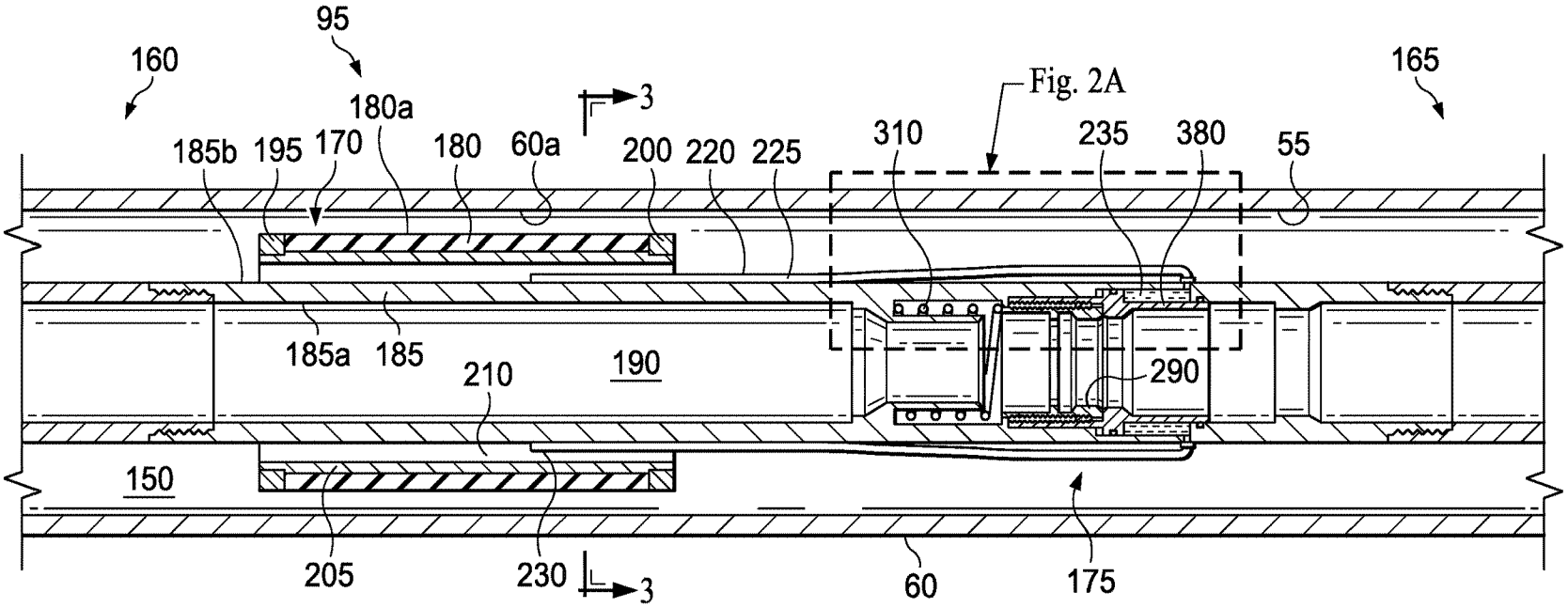
FIG. 2 illustrates a sectional view of the packer assembly of FIG. 1, the packer assembly including an injection assembly, according to an exemplary embodiment of the present disclosure.

In an exemplary embodiment and as illustrated in FIG. 2, the packer assembly 95 is located within the wellbore 55 (FIG. 1) to fluidically isolate longitudinal portions of the annulus 150. In one or more embodiments, the packer assembly 95 is deployed in conjunction with an injection assembly 175. In the illustrated embodiment, the packer assembly 95 includes a swell packer 170. The swell packer 170 generally includes a seal element 180 that is concentrically disposed about a base pipe 185. The base pipe 185 has an interior surface **185*a* and an exterior surface 185*b*. The base pipe 185 also has an interior flow passage 190. End rings 195 and 200 are located an opposing ends of the seal element 180 to secure the seal element 180 against longitudinal displacement relative to the base pipe 185. In one or more embodiments, the seal element 180 is bonded and/or molded onto the base pipe 185, and the end rings 195** and 200 are threaded or welded to the base pipe 185, to thereby form a unitary construction. However, in other embodiments, the seal element 180 may not be bonded to the base pipe 185 and the end rings 195 and 200 may be clamped or otherwise secured to the base pipe 185, in order to provide for adjustment of the rotational alignment of these components at the time of installation. Thus, the disclosure is not limited to a particular configuration for mounting of the seal element 180. In any event, in one or more embodiments, the seal element 180 includes a swellable or expandable material. The term "swell" and similar terms (such as "swellable") are used herein to indicate an increase in volume of a material. Typically, this increase in volume is due to incorporation of molecular components of a fluid, which is pumped downhole or which is present downhole, into the swellable material itself, but other swelling mechanisms or techniques may be used, if desired. Regardless, the seal element 180 is configured to expand, swell, or move outwardly in a radial direction, relative to a longitudinal axis of the base pipe 185, towards the casing string 60 until an exterior surface 180*a* of the seal element 180 sealingly engages an interior surface 60*a* of the casing string 60. That is, the seal element 180 expands, swells, or moves outwardly so that the exterior surface 180*a* of the seal element 180 contacts the interior surface 60*a* of the casing string 60 to prevent or resist a liquid from passing from the third zone 165 of the wellbore 55 from a second zone 160 of the wellbore 55 through the annulus 150 and to prevent or resist a liquid from passing from the second zone 160 to the third zone 165 through the annulus 150. A variety of seal elements are contemplated and in one or more embodiments, the seal element is not limited to a swellable seal element.

Figure 2A:
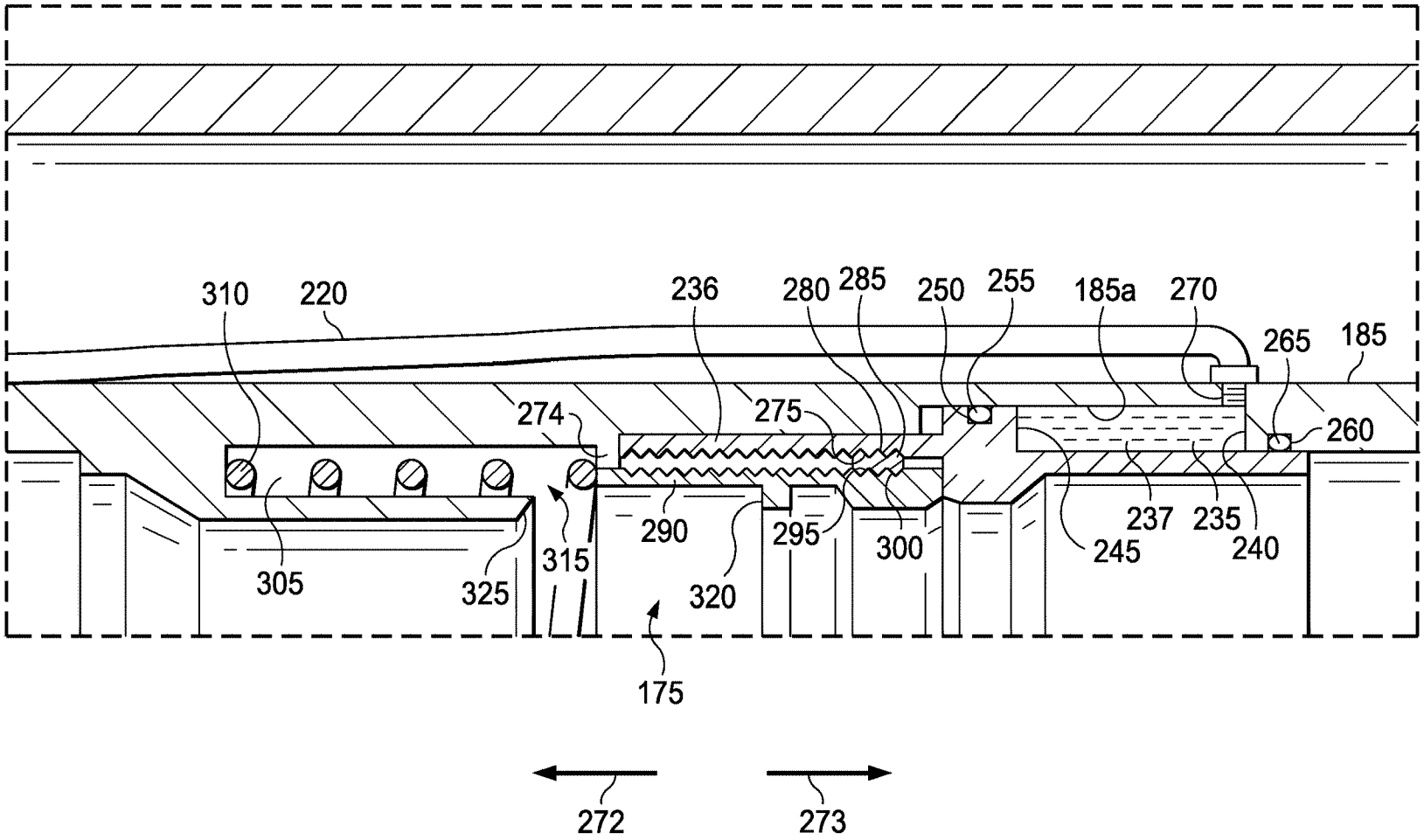
FIG. 2A illustrates a sectional view of the injection assembly of FIG. 2 according to an exemplary embodiment of the present disclosure.
Figure 3:
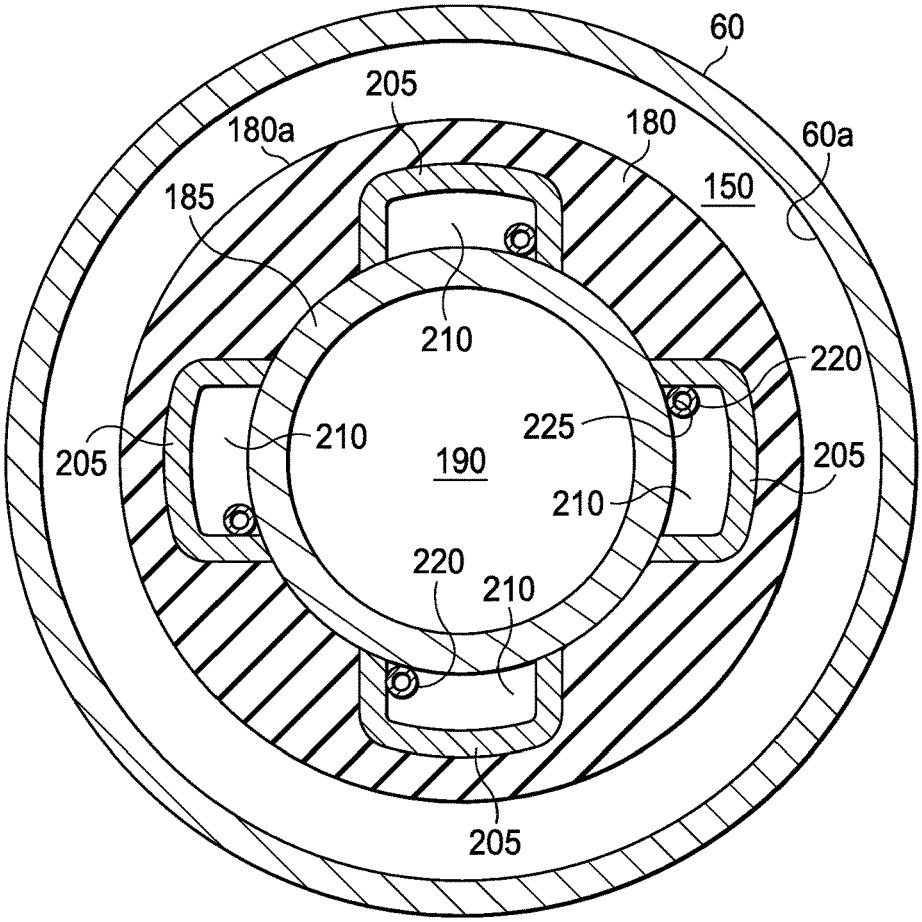
FIG. 3 illustrates a cross-sectional view of the packer assembly of FIG. 2, according to an exemplary embodiment of the present disclosure.

As illustrated in FIGS. 2, 2A, and 3, the packer assembly 95 has shunt tubes 205 that form flow bypasses 210 that extend in the longitudinal direction along the base pipe 185. In one or more embodiments, the shunt tubes 205 extend along the base pipe 185 so that a fluidic material, or a slurry 215 (shown in FIG. 7), can flow past the seal element 180 when the seal element 180 is deployed. That is, the flow bypasses 210 permit the slurry 215 to flow from the third zone 165 to the second zone 160 and from the second zone 160 to the third first zone 155 even when the seal elements 180 are deployed. In one or more embodiments, the slurry 215 is a mixture of proppant (e.g., sized ceramic particles or sized sand or "gravel") and gelled fluid mixed to carry the proppant. In one or more embodiments, the flow bypasses 210 extend between the exterior surface 180*a* of the seal element 180 and the exterior surface 185*b* of the base pipe 185. In one or more embodiments, the longitudinal axis of the flow bypasses 210 are laterally offset (parallel to) from the longitudinal axis of the base pipe 185. In one or more embodiments, the flow bypasses 210 are circumferentially-spaced about the exterior surface 185*b* of the base pipe 185.

Control lines 220 that form fluid passageways 225 are positioned in proximity to or adjacent the flow bypasses 210. In one or more embodiments, the control lines 220 extend within flow bypasses 210. In one or more embodiments, each of the control lines 220 extends along a corresponding one of the flow bypasses 210. In one or more embodiments, the control lines 220 each has a discharge end 230 that is located within a flow bypass 210, or otherwise, located along the length of the swell packer 170. In one or more embodiments, the discharge ends 230 are located so an injectable setting fluid 235 that exits the discharge ends 230 enters the flow bypasses 210. In one or more embodiments, the control lines 220 extend along the exterior surface 185*b* of the base pipe 185. However, the fluid passageways 225 may be formed within the base pipe 185.

In one or more embodiments, the control lines 220 are fluidically coupled to a fluid chamber or reservoir 237. Although preferably located in proximity to the base pipe 185, the fluid chamber 237 may be remotely located. In one or more embodiments, an injection assembly 175 may be fluidically coupled to the control lines 220 and the fluid chamber 237 to drive the fluid from the fluid chamber 237 to the control lines 220. The injection assembly may be formed along the base pipe 185. In one or more embodiments, the injection assembly 175 includes a piston sleeve 236 disposed within the base pipe 185. The fluid chamber 237 may be formed between the base pipe 185 and the piston sleeve 236 and defined in the radial direction by an exterior surface of the piston sleeve and the interior surface 185*a* of the base pipe 185. The fluid chamber 237 is defined in the longitudinal direction by a radial extending face 240 formed by the interior surface 185*a* of the base pipe 185 and a radially extending face 245 formed by the piston sleeve 236. A groove 250 is formed within the exterior surface of the piston sleeve 236 to accommodate a sealing element 255, such as an o-ring and a groove 260 is formed within the interior surface 185*a* of the base pipe 185 to accommodate a sealing element 265, such as an o-ring. The sealing elements 255 and 265 seal the fluid chamber 237. The fluid chamber 237 stores the fluid 235. The control lines 220 are fluidically coupled to the fluid chamber 237 via a plurality of ports 270 (only one shown in FIG. 2A). The piston sleeve 236 is capable of moving in a direction indicated by an arrow 272 or an opposing direction indicated by an arrow 273 to change the volume of the fluid chamber 237. An inwardly extending lip 274 formed in the interior surface 185*a* of the base pipe 185 provides a stop in the direction indicated by the arrow 272 for the piston sleeve 236. The interior surface of the piston sleeve 236 forms ridges 275 configured to couple to ridges 280 formed on the exterior surface of a locking ring 285. The locking ring is concentrically disposed within the piston sleeve 236. A support sleeve 290 is concentrically disposed within the locking ring 285 and the exterior surface of the support sleeve 290 forms ridges 295 that are configured to couple to ridges 300 formed on the interior surface of the locking ring 290. The ridges 275 and 280 form a ratcheting system between the piston sleeve 236 and the locking ring 285 that permits relative movement between the piston sleeve 236 and the locking ring 285 in one longitudinal direction. The ridges 295 and 300 form a ratcheting system between the locking ring 285 and the support sleeve 290 that permits relative movement between the locking ring 285 and the support sleeve 290 in one longitudinal direction. A spring housing, or pocket 305, is formed within the base pipe 185 and extends in the direction indicated by the direction indicated by the arrow 272 from the lip 274. The pocket 305 accommodates a spring 310. The pocket 305 forms an opening 315 through which the support sleeve 290 extends to energize the spring 310. In one or more embodiments, the support sleeve 290 has an inwardly extending lip 320 that couples to a shifting tool (not shown in FIG. 2A), which moves the support sleeve 290 in the direction indicated by the arrow 272 to energize the spring 310. A deflection shoulder 325 formed within the base pipe 185 decouples the shifting tool from the extending lip 320 of the support sleeve 290 once the spring 310 is energized to release the support sleeve 290 from the shifting tool. When the support sleeve 290 is released from the shifting tool, the spring 310 is also released. Due to the ratcheting systems formed between the support sleeve 290 and the locking ring 285 and the locking ring 285 and the piston sleeve 236, the release of the spring 310 moves the support sleeve 290, the locking ring 285, and the piston sleeve 236 in the direction indicated by the arrow 273 to reduce the volume of the fluid chamber 237. That is, the piston sleeve 236 is movable from a first position in which the fluid chamber 237 is not pressurized to a second position in which the fluid chamber 237 is pressurized. The piston sleeve 236 moves in the direction indicated by the arrow 273 when moving from the first position to the second position.

Although the shunt tubes 205 and the flow bypasses 210 have a rounded rectangular or a u-shape configuration, as depicted in FIG. 3, any shape may be utilized (e.g., square, circular, oval, etc.), as desired. That is, the shunt tubes 205 could also be square, rectangular, round, or kidney shaped tubular members. In one or more embodiments, these members can be welded, sealed, fastened, glued, or affixed using a similar method to seal to the base pipe 185 to form the flow bypasses 210. Similarly, the seal element 180 may also be bonded, glued, mechanically attached or otherwise similarly secured to the shunt tube 205 and the base pipe 185. Any number and combination of the shunt tubes 205, the flow bypasses 210, the control lines 220, and the passageways 225 may be used in keeping with the principles of this disclosure. In an exemplary embodiment, the shunt tubes 205 extends radially inward of the exterior surface 180*a* of the seal element 180. That is, the shunt tubes 205 are located radially between an exterior surface of the casing string 60 and the exterior surface 180*a* of the seal element 180.

Figure 4:
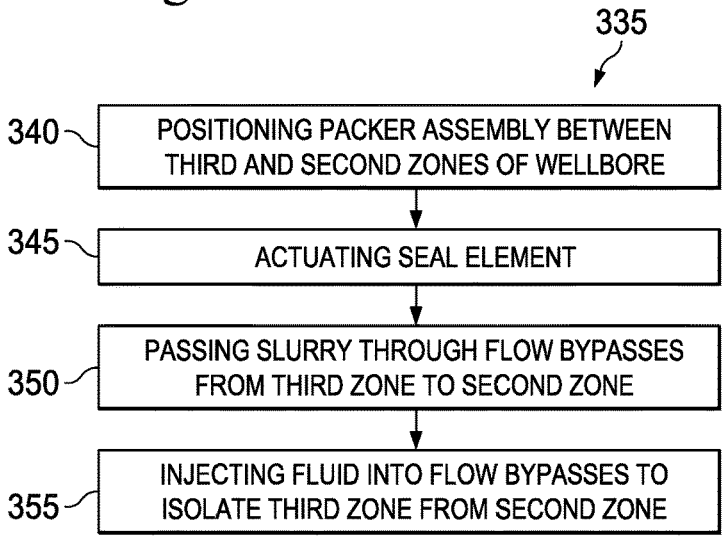
FIG. 4 is a flow chart illustration of a method of operating the apparatus of FIG. 2, according to an exemplary embodiment of the present disclosure.

In an exemplary embodiment and as illustrated in FIG. 4 with continuing reference to FIGS. 1-3, a method 335 of isolating, in a wellbore, production zones along a production tubing includes positioning a packer assembly, such as the packer assembly 95, between adjacent production zones at step 340, actuating the seal element of the packer assembly at step 345, passing a slurry from one zone to the other zone via flow bypasses at step 350, and injecting a sealing, or setting fluid, such as fluid 235, into the flow bypasses to isolate one zone from the other zone at step 355. In one or more preferred embodiments, the foregoing method may include position a packer assembly between the third zone 165 and the second zone 160 of the wellbore 55 at the step 340, actuating the seal element 180 at the step 345, passing the slurry 215 from the third zone 165 to the second zone 160 via the flow bypasses 210 at the step 350, and injecting a fluid 235 into the flow bypasses 210 to isolate the third zone 165 from the second zone 160 at the step 355.

In an exemplary embodiment and as illustrated in FIG. 2, the packer assembly 95 is positioned within the wellbore 55 at a location between adjacent production zones, such as the third zone 165 and the second zone 160 at the step 205. As shown in FIG. 2, the seal element 180 is positioned downhole while in a non-expanded state. That is, the seal element 180 has not expanded to contact the interior surface 60*a* of the casing string 60 (or the inner surface of wellbore 55). In the non-expanded state, a formation fluid may pass between adjacent zones, such as the third zone 165 and the second zone 160 via the annulus 150 between the exterior surface 180*a* of the seal element 180 and the interior surface 60*a* of the casing string 60 (or the inner surface of the wellbore 55). That is, the exterior surface 180*a* of the seal element is radially spaced from the interior surface 60*a* of the casing string or the inner surface of the wellbore 55. In one or more embodiments, the fluid chamber 237 is filled with the fluid 235 at the surface of the well.

Figure 5:
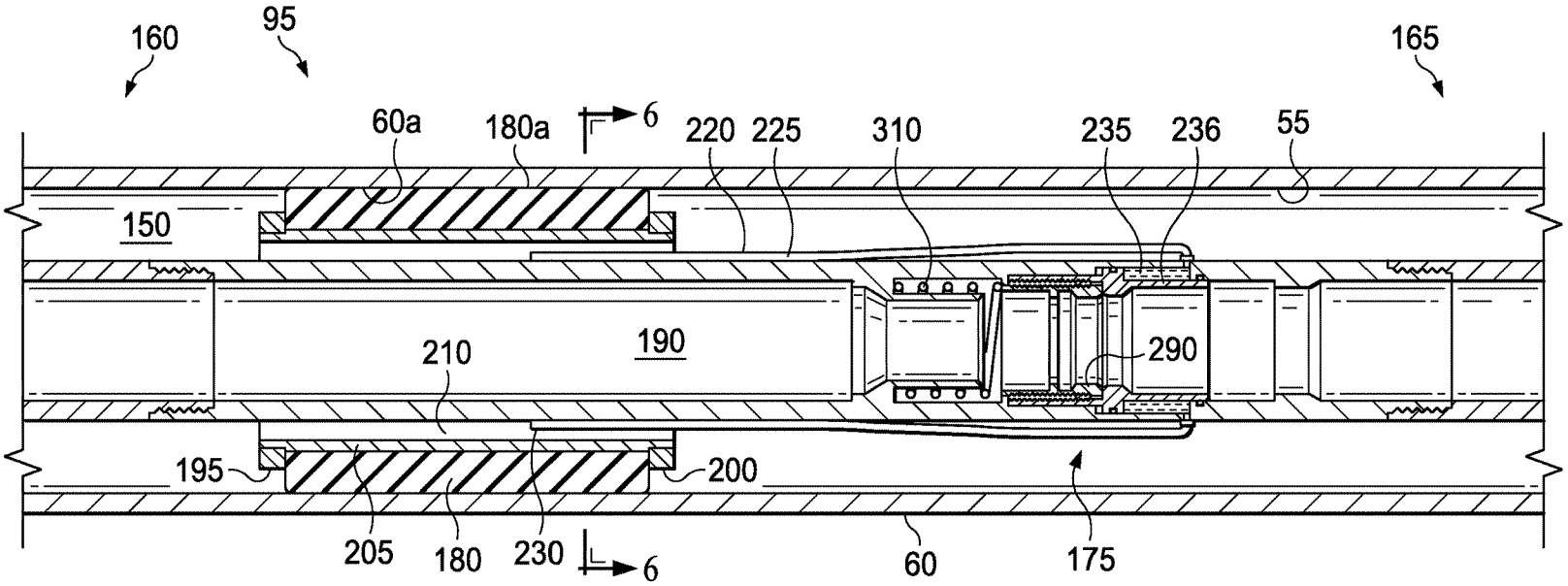
FIG. 5 illustrates a sectional view of the packer assembly of FIG. 2 during the execution of a step of the method of FIG. 4, according to an exemplary embodiment of the present disclosure.
Figure 6:
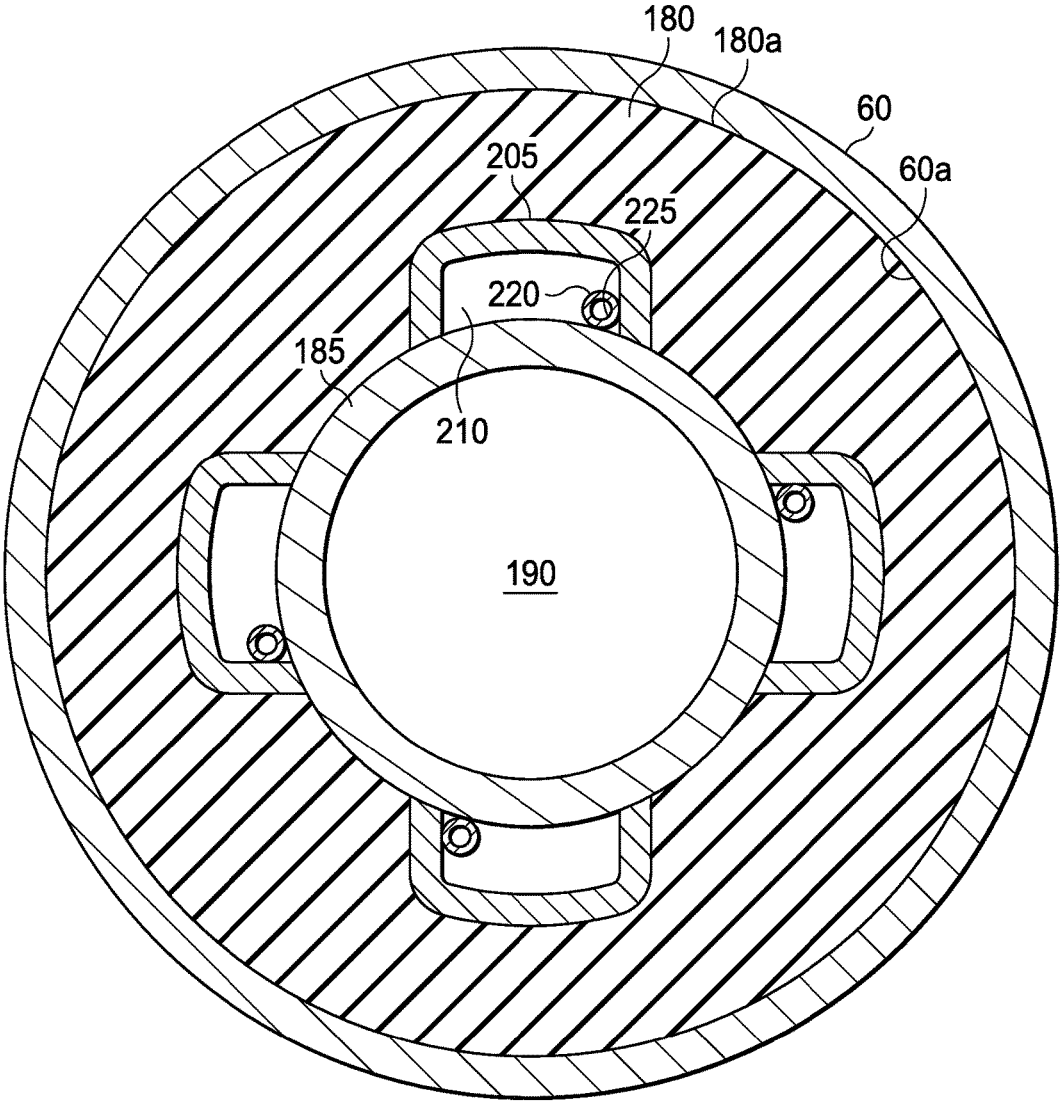
FIG. 6 illustrates a cross-sectional view of the packer assembly of FIG. 2 during the execution of a step of the method of FIG. 4, according to an exemplary embodiment of the present disclosure.

In an exemplary embodiment and as illustrated in FIGS. 5 and 6, the seal element 180 is actuated at the step 345. In one or more embodiments, the seal element 180 is expanded. This expansion may be caused by a chemical reaction between the seal element 180 and a fluid surrounding the seal element 180, a mechanical reaction triggered by a setting tool, or other methods for driving the seal element 180 into sealing engagement with the interior surface 60*a* of the casing string 60. Multiple methods of expanding or actuating the seal element 180 are contemplated here. Regardless, actuation of the seal element 180 results in the exterior surface 180*a* of the seal element 180 sealingly engaging the interior surface 60*a* of the casing string 60 (or the inner surface of the wellbore 55). In one or more embodiments, a cross-sectional area of each of the flow bypasses 210 is maintained in a flow-through configuration throughout the actuation of the seal element 180. That is, the actuation or expansion of the seal element 180 does not deform the shunt tubes 205 or otherwise reduce the cross-sectional area of the shunt tubes 205 or the flow bypasses 210.

Figure 7:
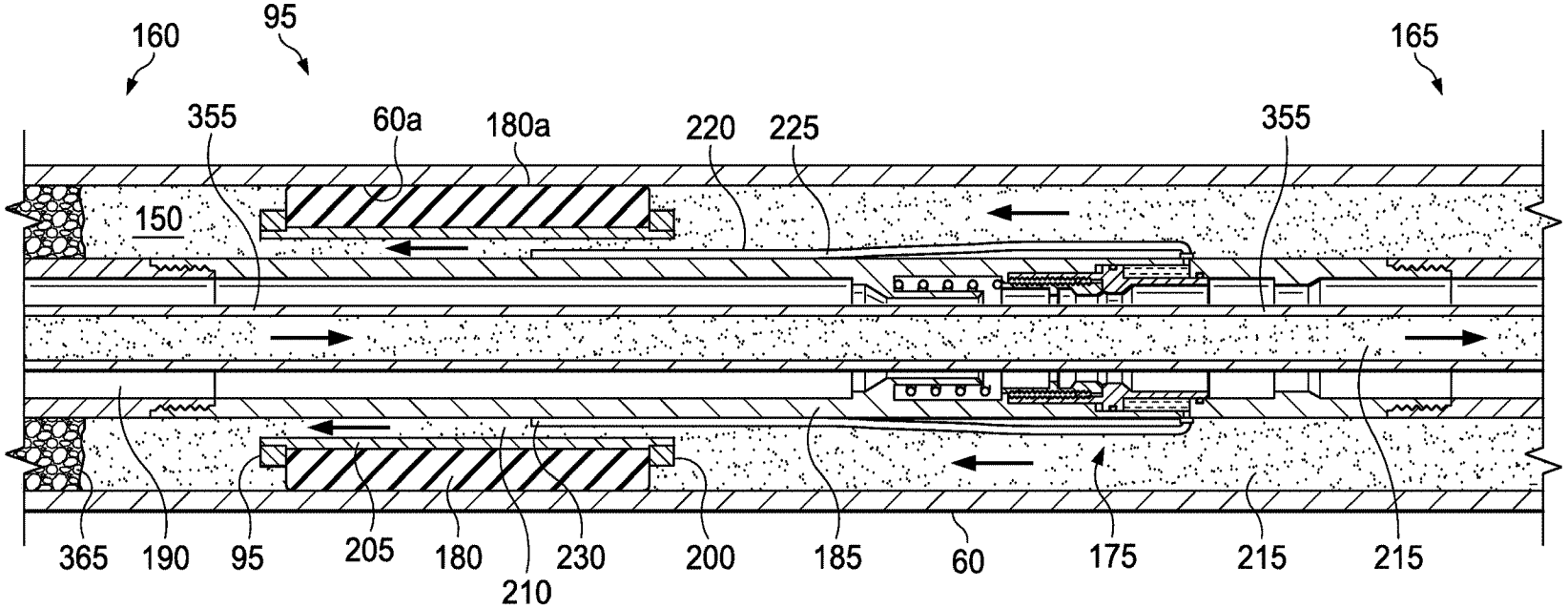
FIG. 7 illustrates a sectional view of the packer assembly of FIG. 2 during the execution of another step of the method of FIG. 4, according to an exemplary embodiment of the present disclosure.
Figure 8:
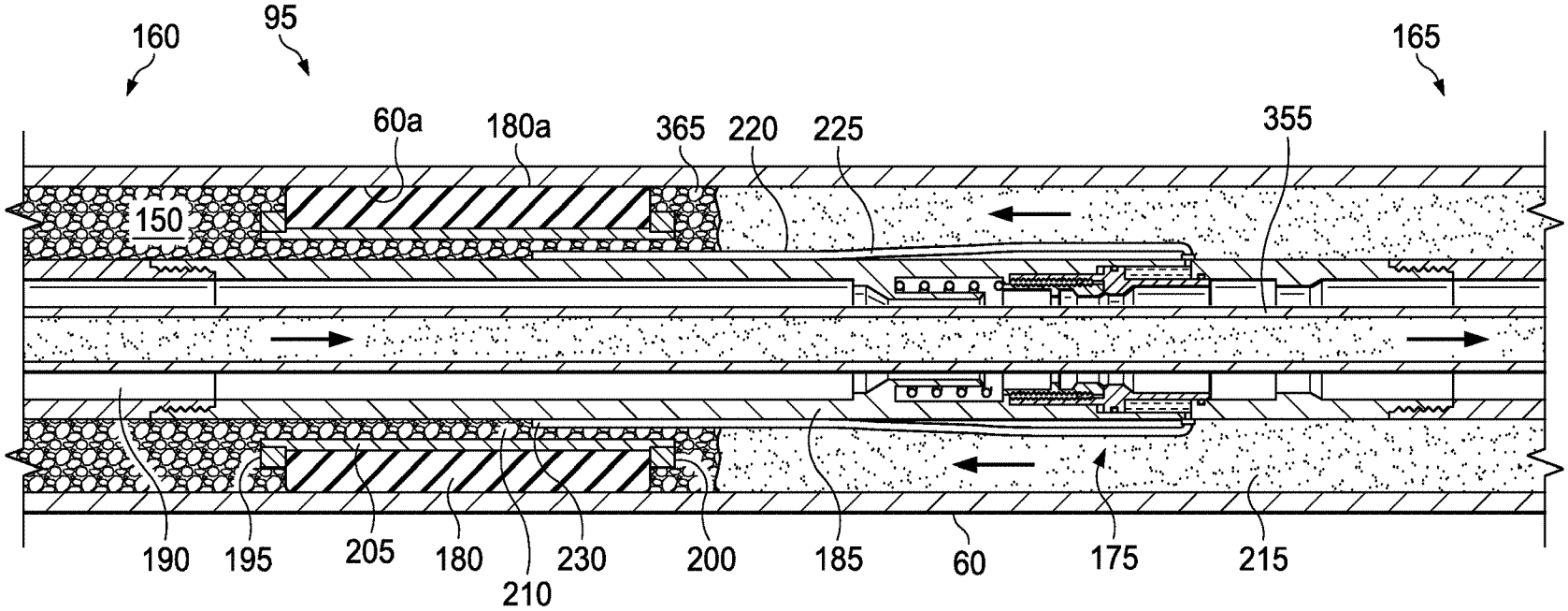
FIG. 8 illustrates a sectional view of the packer assembly of FIG. 2 during the execution of yet another step of the method of FIG. 4, according to an exemplary embodiment of the present disclosure.

In an exemplary embodiment and as illustrated in FIGS. 7 and 8, the slurry 215 passes through the flow bypasses 210 at the step 350. In one or more embodiments, a tubing 355 extends within the interior flow passage 190 to pump the slurry 215 downhole. The slurry 215 exits the tubing 355 and the tubing string 50 downhole of the packer element 180. In one or more embodiments, the slurry 215 may be released near the toe of the well. In one or more embodiments, the tubing 355 includes a shifting tool 360 (shown in FIG. 9) located on the exterior surface of the tubing 355. In one or more embodiments involving "fishhook" wells, the slurry 215 may be released from the tubing string 50 near the toe of the well and "falls" through the annulus 150 of the third zone 165, through the flow bypasses 210, and into the annulus 150 of the second zone 160. In one or more embodiments, the release point of the slurry 215 from the tubing 355 is located at an elevation that is above the elevation of the packer assembly 95. Therefore, due to gravity, the slurry 215 "falls" down from the release point to the packer assembly 95. In one or more embodiments, the fluid bypasses 210 permit the slurry 215 to flow through one end of the seal element 180 that is associated with the third zone 165 to another end of the seal element 180 that is associated with the second zone 160 while the exterior surface 180*a* of the seal element 180 sealingly engages the interior surface 60*a* of the casing string 60. The flow of slurry 215 through the flow bypasses 210 permits a gravel, or a proppant 365, within the slurry 215 to accumulate within the annulus 150 at a location towards the heel of the well, from the packer assembly 95. As additional slurry 215 is passed through the flow bypasses 210, the accumulation of the proppant 365 within the annulus 150 builds towards the toe of the well. The proppant 365, which forms a part of the slurry 215, may be disposed or accommodated within the flow bypasses 210. In one or more embodiments, a volume of proppant 365 is packed along a length of the swell packer 170 and between the base pipe 185 and the interior surface 60*a* of the casing string 60 or the interior surface of the wellbore 55. In one or more embodiments, the proppant 365 may be of any size. That is, the proppant 365 may be a fine sand having small granules or may be a coarse sand or gravel having large pebbles. However and in one embodiment, the movement of the slurry 215 within the wellbore 55 is not solely dependent upon gravity, but instead is dependent upon a variety of factors and forces. Typically, the gelled fluid of the slurry 215 flows through voids formed in the packed proppant 365 that is deposited with the flow bypasses 210 and the annulus 150 to exit the annulus 150 at a location at or near the heel of the well via an opened filter or screen (not shown). In one or more embodiments, this flow of the gelled fluid of the slurry 215 through the annulus 150 and the flow bypasses 210 helps to "pack" the proppant 365 to prevent or at least reduce the amount of voids or spaces in the proppant 365 that is disposed within the flow bypasses 210 and the annulus 150. In one or more embodiments, the slurry 215 continues to be pumped from near the toe of the well through the annulus 150 until the well is "packed." In one or more embodiments, when the well is packed, the proppant 365 has filled at least the annulus 150 in the third zone 165, the annulus 150 in the second zone 160, and the fluid bypasses 210. Generally, after the well is packed and as shown in FIG. 9, pumping operations are over and any fluid (i.e., the gelled fluid) inside the annulus 150 is static or near static.

Figure 9:
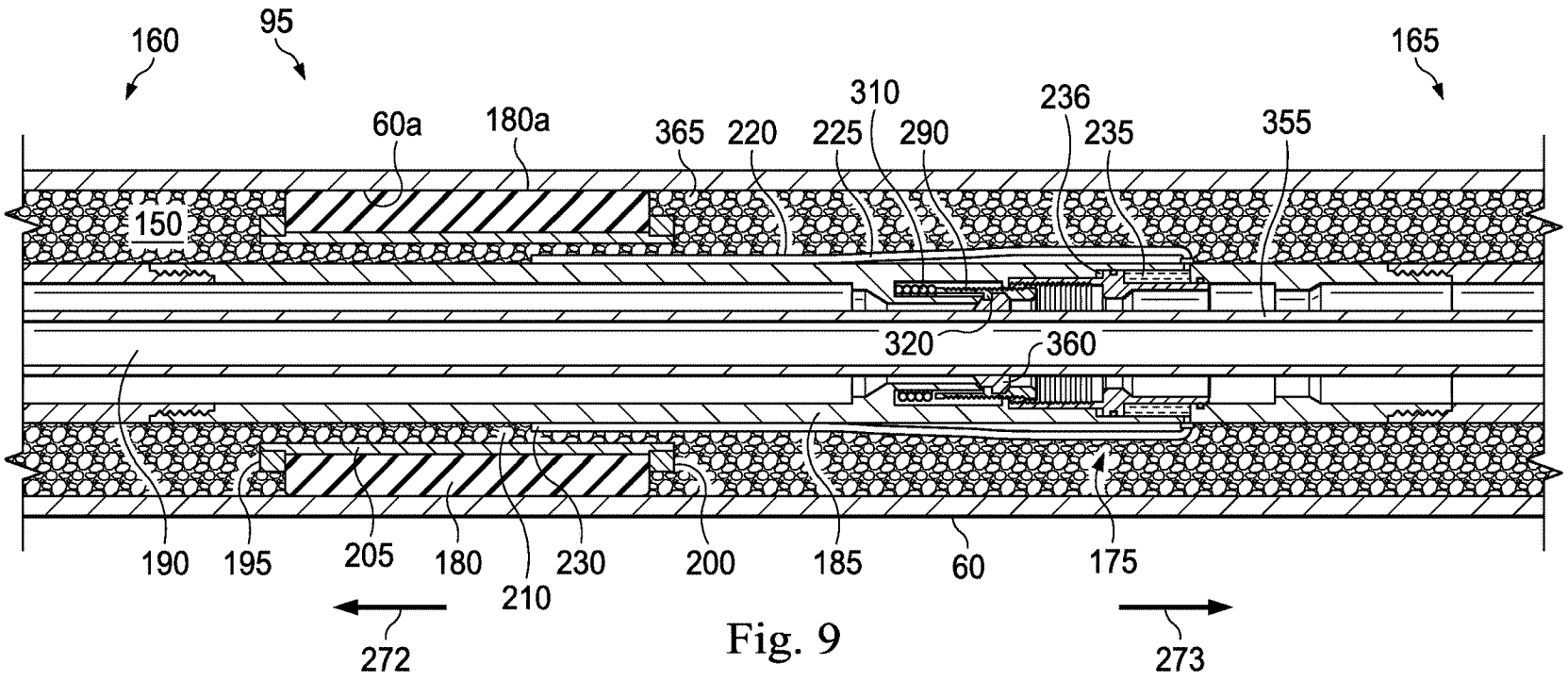
FIG. 9 illustrates a sectional view of the packer assembly of FIG. 2 during the execution of yet another step of the method of FIG. 4, according to an exemplary embodiment of the present disclosure.
Figure 10:
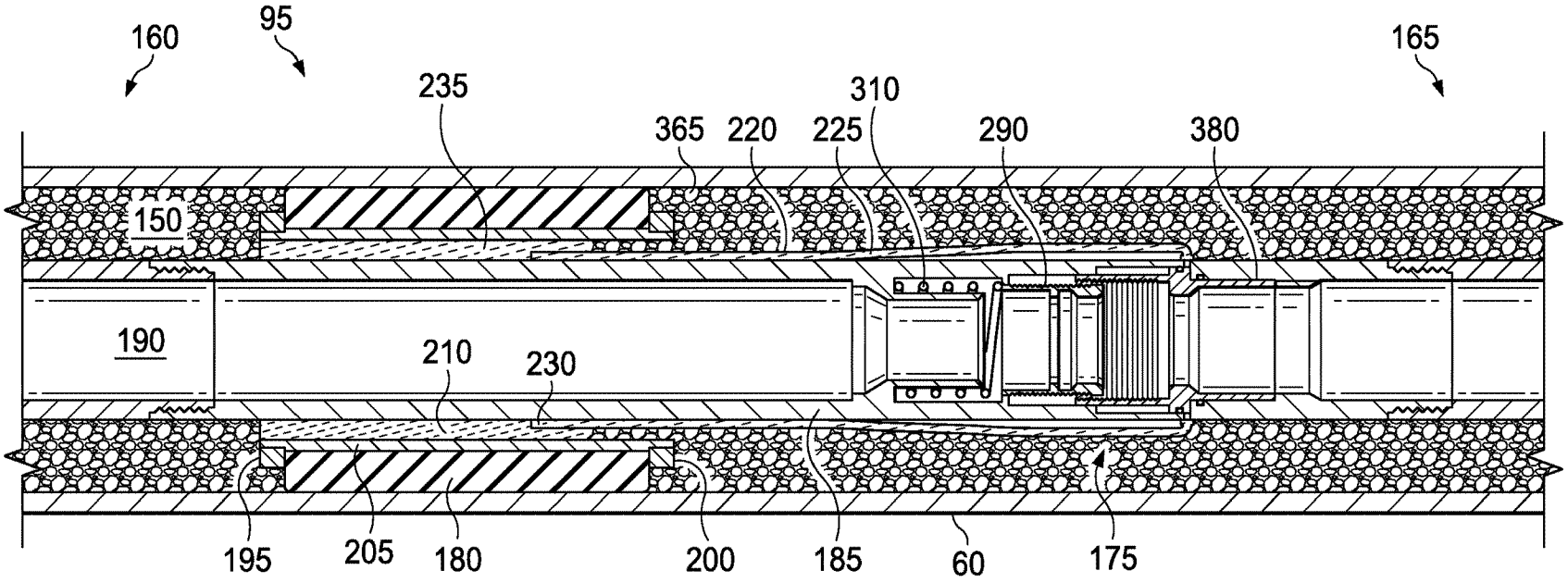
FIG. 10 illustrates a sectional view of the packer assembly of FIG. 2 during the execution of yet another step of the method of FIG. 4, according to an exemplary embodiment of the present disclosure.

In an exemplary embodiment and as illustrated in FIGS. 9 and 10, the fluid 235 is forced or injected into the flow bypasses 210 to isolate the third zone 165 from the second zone 160 at the step 355. In one or more embodiments, the shifting tool 360, as the tubing 355 is removed from the well, activates the spring 310, which causes the injection assembly 175 to reduce the volume of the fluid chamber 237. This reduction of volume pressurizes the volume of the fluid 235, to force or inject the fluid 235 into the flow bypasses 210. In an exemplary embodiment and with reference to FIG. 2A, as the tubing 355 is removed from the well (i.e., moved in the direction towards the heel of the well), the shifting tool 360 engages the inwardly extending lip 320 of the support sleeve 290 and pulls the support sleeve 290 in the direction indicated by the arrow 272. In one or more embodiments, this movement of the support sleeve 290 energizes the spring 310. Continued movement of the shifting tool 360 in the direction indicated by the arrow 272 causes the shifting tool 360 to contact the deflection shoulder 325, which causes the shifting tool 360 to decouple from the support sleeve 290. Once the shifting tool 360 decouples from the support sleeve 290 and due to the ratcheting systems formed between the locking ring 285 and the support sleeve 290 and the piston sleeve 236 and the locking ring 285, the support sleeve 290, the locking ring 285, and the piston sleeve 236 together move in the direction indicated by the arrow 273 due to the release of the spring 310. Movement of the support sleeve 290 in the direction indicated by the arrow 273 pressurizes the fluid 235 in the fluid chamber 237 to cause the fluid 235 to exit the fluid chamber 237 via the ports 270 and into the fluid passageways 225. As illustrated in FIG. 10, the volume of the fluid chamber 237 has been reduced so that the fluid 235 has exited the fluid chamber 237. After injection from the fluid chamber 237, the fluid 235 is disposed within the fluid bypasses 210 between any voids or spaces in the proppant 365. In one or more embodiments, the fluid 235 is an injectable setting fluid that cures within the fluid bypasses 210 to fluidically seal the third zone 165 from the second zone 160. After the fluid 235 cures or solidifies within the voids or spaces in the proppant 365 that is located within the fluid bypasses 210, fluid is prevented from passing through each of the fluid bypasses 210.

In one or more embodiments, the fluid 235 is an epoxy or sealant. In one or more embodiments, the fluid 235 is a room temperature vulcanizing silicone sealant. However, the fluid 235 may be any type of vulcanizing silicone sealant. In one or more embodiments, the fluid 235 is an organically cross-lined polymer that forms a permanent seal, such as for example, H2ZERO from Halliburton Energy Services, Inc. of Houston, Tex. In one or more embodiments, the fluid 235 is a synthetic polymer capable of absorbing 30 to 400 times its water weight, such as for example, CRYSTALSEAL® by Halliburton Energy Services, Inc. of Houston, Tex. However, the fluid 235 may be any type of injectable liquid that hardens into a solid or semi-solid form.

In one or more embodiments, the method 335 may be used to effectively isolate zones in a "fishhook" well after the well has been packed with the proppant 365. In one or more embodiments, each of the flow bypasses 210 allows for even distribution of gravel or proppant 365 within the annulus 150 when a gravel packing operation is performed. In one or more embodiments, the method 335 may be used to create a liquid-tight seal between the exterior surface 180*a* of the seal element 180 and the interior surface 60*a* of the casing string 60 (or the inner surface of the wellbore 55) prior to injecting the proppant 365 in the annulus 150 during the gravel packing operation. In one or more embodiments, the method 335 may be used to prevent or resist a production fluid from entering the third zone 165 from the second zone 160 via the annulus 150 or vice versa. In one or more embodiments, the exterior surface 180*a* engages the interior surface 60*a* or the wellbore 55 prior to injecting the proppant 365 in the annulus 150. In one or more embodiments, the method 335 may be used to reduce the amount of "stringers" associated with isolating zones during the gravel packing operation. In one or more embodiments, the method 335 requires small volumes of the fluid 235 to isolate zones in the gravel packing operation. In one or more embodiments, the volume of fluid 235 required for each packer assembly 95 is less than 10 gallons. In one or more embodiments, the volume of fluid 235 required for each packer assembly 95 is less than 5 gallons. However, the volume of fluid 235 required for each packer assembly 95 varies depending on the number of flow bypasses 210 associated with each packer assembly 95. In one or more embodiments, the volume of fluid 235 required for each packer assembly 95 is approximately 2 or 3 gallons. In one or more embodiments, the method 335 allows for a wider variety of materials to be used as the fluid 235 due to the reduced volume required and the precise disbursement of the fluid 235 to the fluid bypasses 210.

Figure 11:
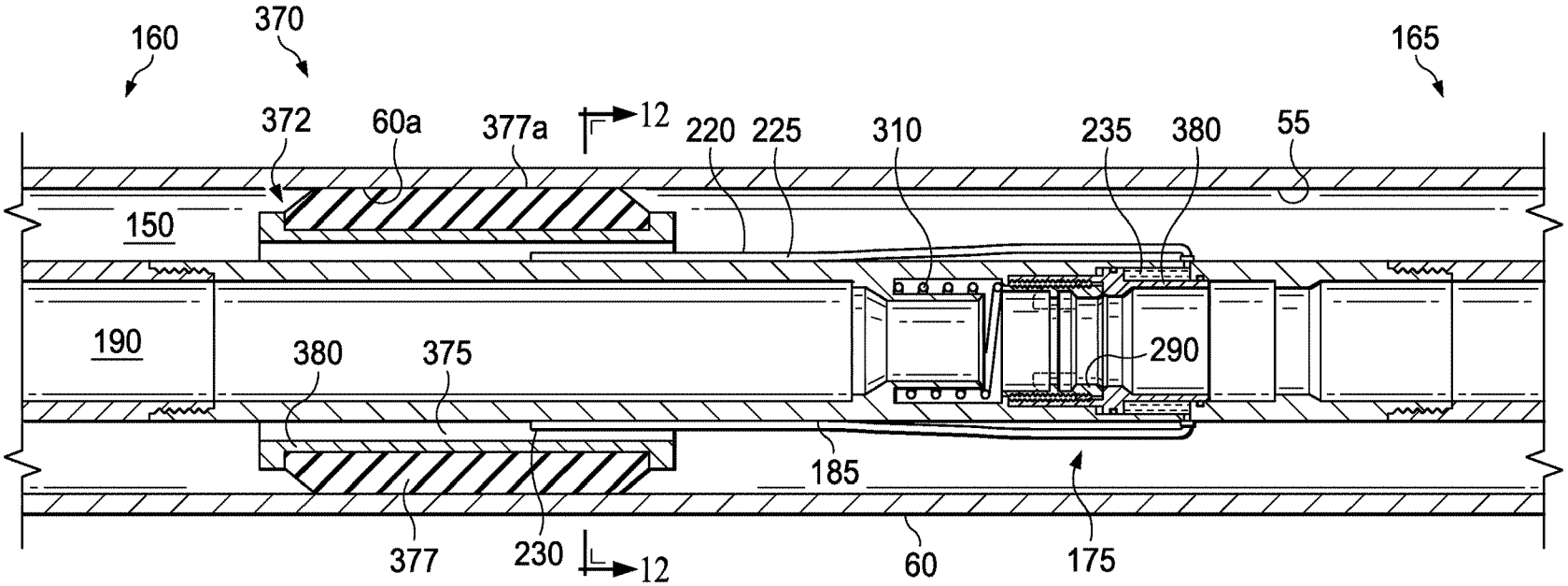
FIG. 11 illustrates a sectional view of the packer assembly of FIG. 2, according to another exemplary embodiment of the present disclosure.
Figure 12:
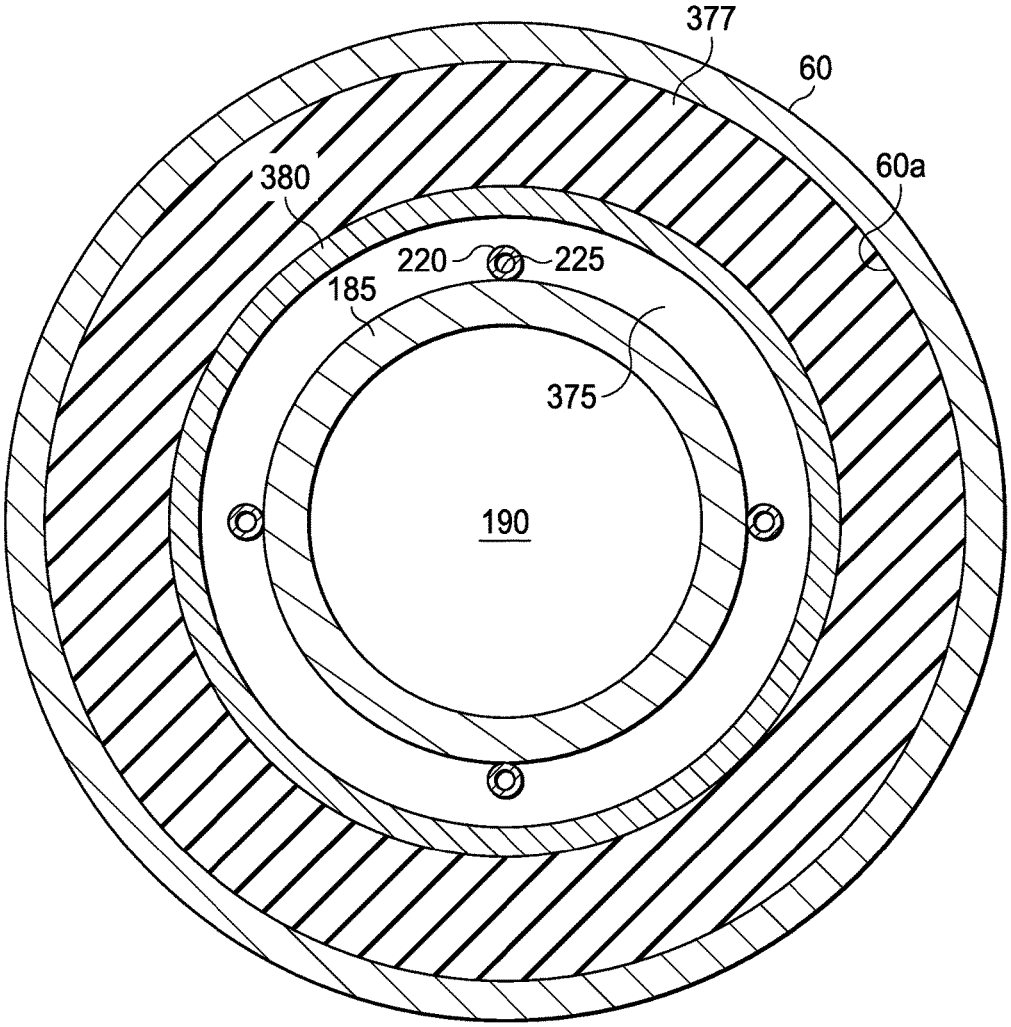
FIG. 12 illustrates a cross-sectional view of the packer assembly of FIG. 11, according to an exemplary embodiment of the present disclosure.

Exemplary embodiments of the present disclosure may be altered in a variety of ways. For example, and as shown in FIGS. 11 and 12, another embodiment of a packer assembly is generally referred to by the reference number 370, and is similar to the packer assembly 95 depicted in FIGS. 1-10 and contains several parts of the packer assembly 95, which are given the same reference numerals. Instead of the swell packer 170, the packer assembly 370 generally includes an annular packer 372 with a shunt tube, or an annular bypass 375, that is concentrically formed about the exterior surface 185*b* of the base pipe 185. Generally, a seal element 377 is similar to the seal element 180 and is concentrically disposed about an exterior surface of an annular sleeve 380 that forms the annular bypass 375 such that an exterior surface 377*a* of the annular sleeve 377 expands to sealingly engage the interior surface of the casing string 60*a* or the wellbore 55. In one or more embodiments, the longitudinal axis of the annular bypass 375 and the longitudinal axis of the base pipe 185 are the same. In this exemplary embodiment, the control lines 220 are circumferentially spaced about the exterior surface 185*b* of the base pipe 185. In one or more embodiments, the annular packer 372 includes a metal shell that is hydro-formed to the wellbore 55 or casing string 60. In one or more embodiments, the seal element 377 of the annular packer 372 is extended by applying pressure to the base pipe 185. The pressure is transferred to the seal element 377 through a pressure port, fluid path, or control line path (not shown). In one or more embodiments, the pressure inside the base pipe 185 is greater than a pressure along the annulus 150 to create a pressure differential to extend the seal element 377. In one or more embodiments, the annular packer 372 is a ZONEGUARD® Packer by Halliburton Energy Services, Inc. of Houston, Tex. In one or more embodiments, the annular packer 372 is a Annular Zonal Isolation Packer by Saltel-Industries, Inc. of Bruz, France. However, any type of annular packer 372 may be used.

Figure 13:
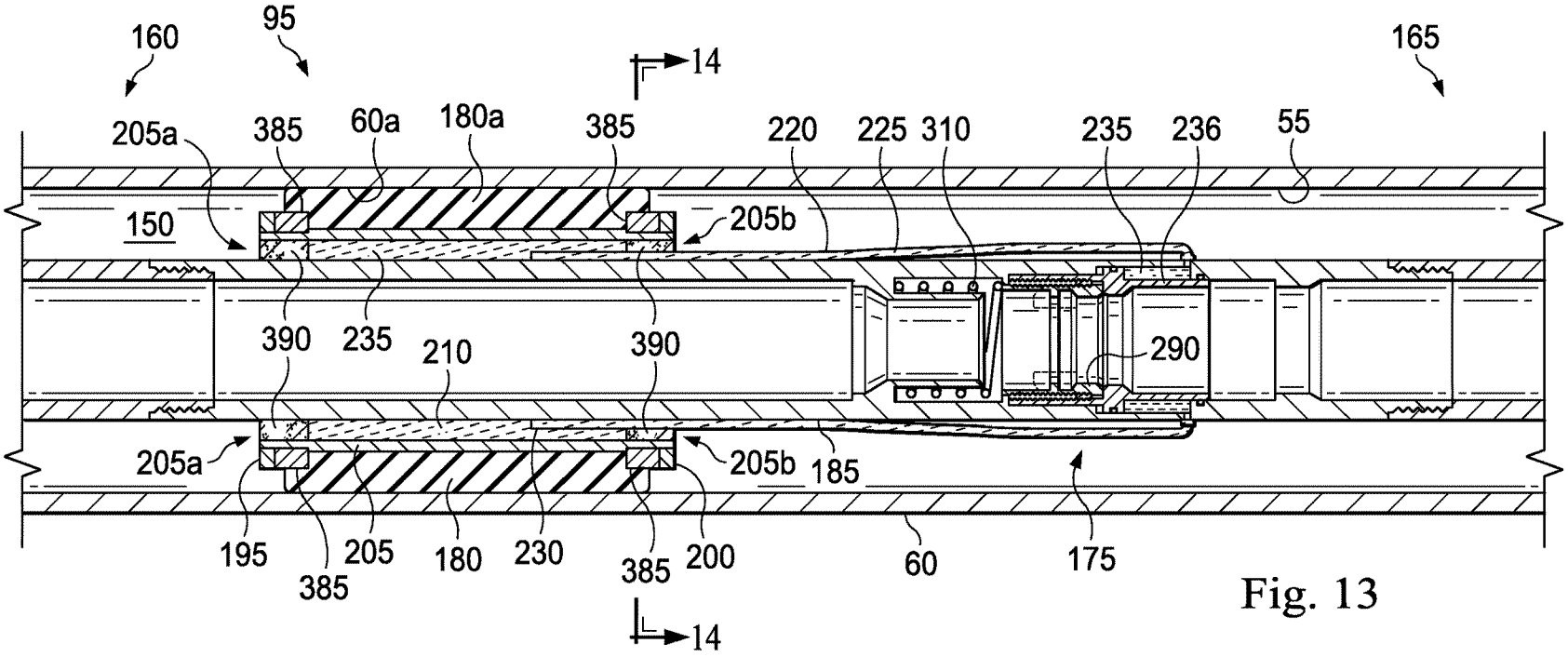
FIG. 13 illustrates a sectional view of the packer assembly of FIG. 2, according to yet another exemplary embodiment of the present disclosure.
Figure 14:
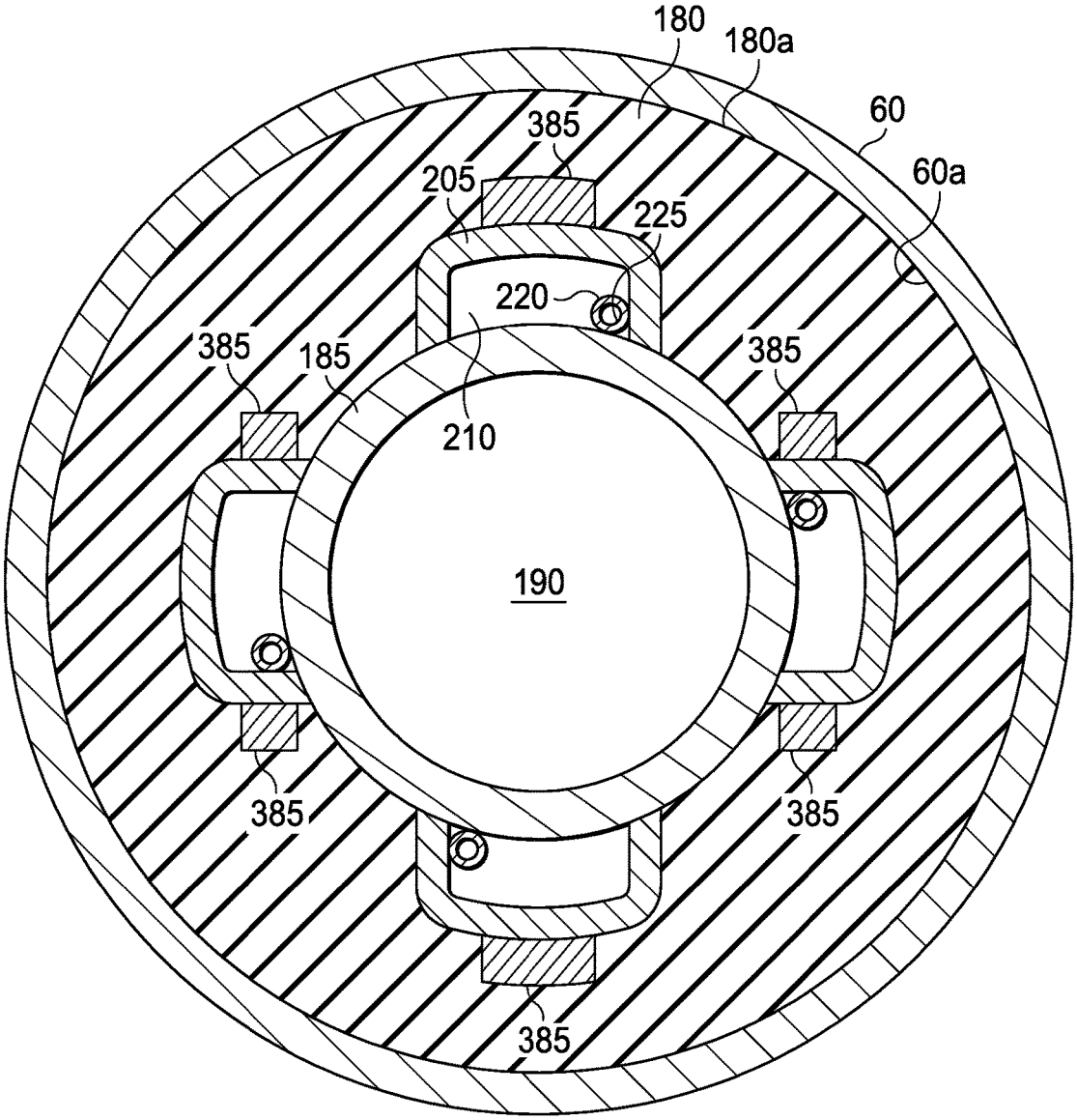
FIG. 14 illustrates a cross-sectional view of the packer assembly of FIG. 13, according to an exemplary embodiment of the present disclosure.

In another exemplary embodiment and as shown in FIGS. 13 and 14 (proppant 365 not shown), magnetized materials, or magnets 385 are disposed along the length of the swell packer 170, proximate each opposing end 205*a* and 205*b* of the shunt tubes 205, or embedded into each opposing end of the seal element 180 of the packer assembly 95. In one or more embodiments, multiple magnets 385 may be disposed about an exterior surface of the shunt tubes 205. Alternatively, a portion of each of the shunt tubes 205 can be formed using one of the magnets 385. In one or more embodiments, the fluid 235 includes a ferrofluid 390. Upon actuation of the injection assembly 175, the fluid 235, which includes the ferrofluid 390, is forced through the passageways 225 and into the fluid bypasses 210. In one or more embodiments, the ferrofluid 390 includes nano-sized, micro-sized, or any size of small particles of metal that is attracted to the magnets 385. The ferrofluid 390 or at least particles within the ferrofluid will be drawn to the magnets 385 to block openings formed by the opposing ends 205*a* and 205*b* of the shunt tubes 205. Thus, the ferrofluid 390 will prevent or at least resist the fluid 235 from exiting the fluid bypasses 210. In another exemplary embodiment, the injection assembly 175 includes another fluid chamber (not shown) that stores the ferrofluid 390 separately from the fluid 235 so that operation of the injection assembly 175 injects the ferrofluid 390 prior to or during the injection of the fluid 235 through the passageways 225.

Figure 15:
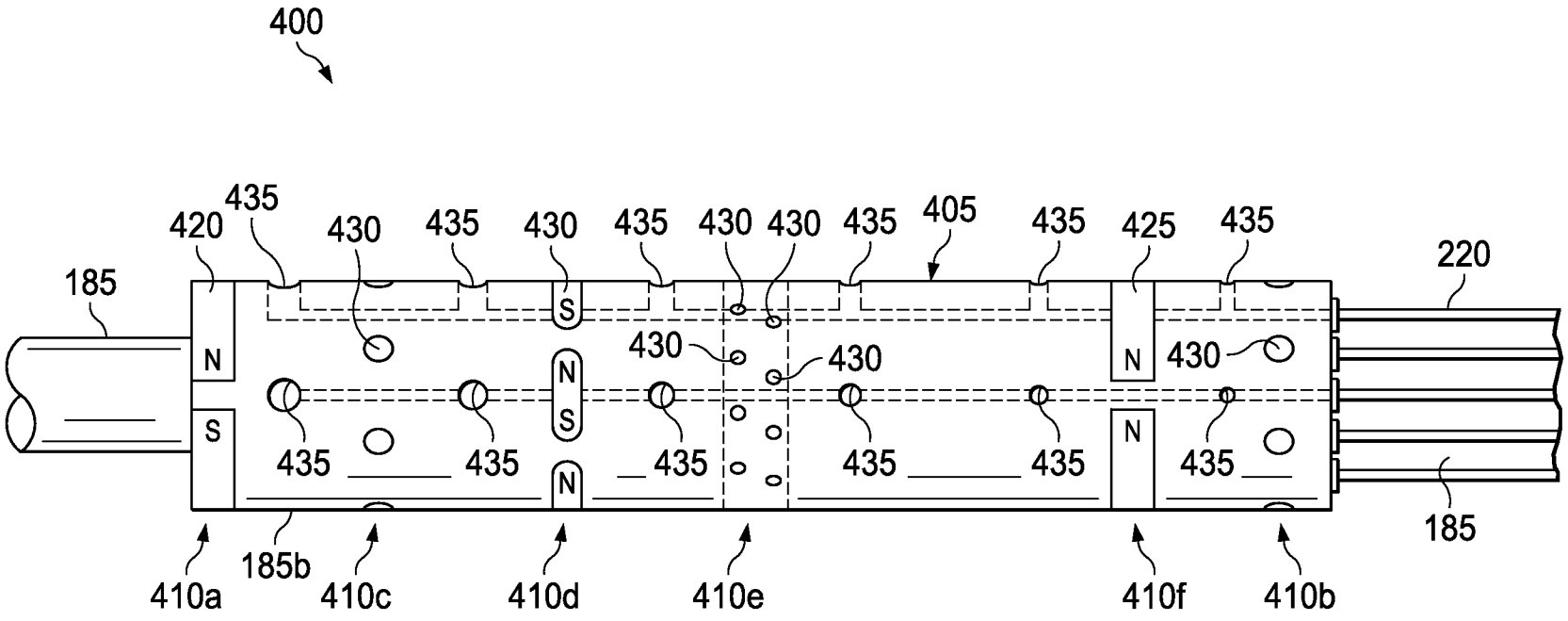
FIG. 15 illustrates a sectional view of the packer assembly of FIG. 2, according to yet another exemplary embodiment of the present disclosure.
Figure 16:
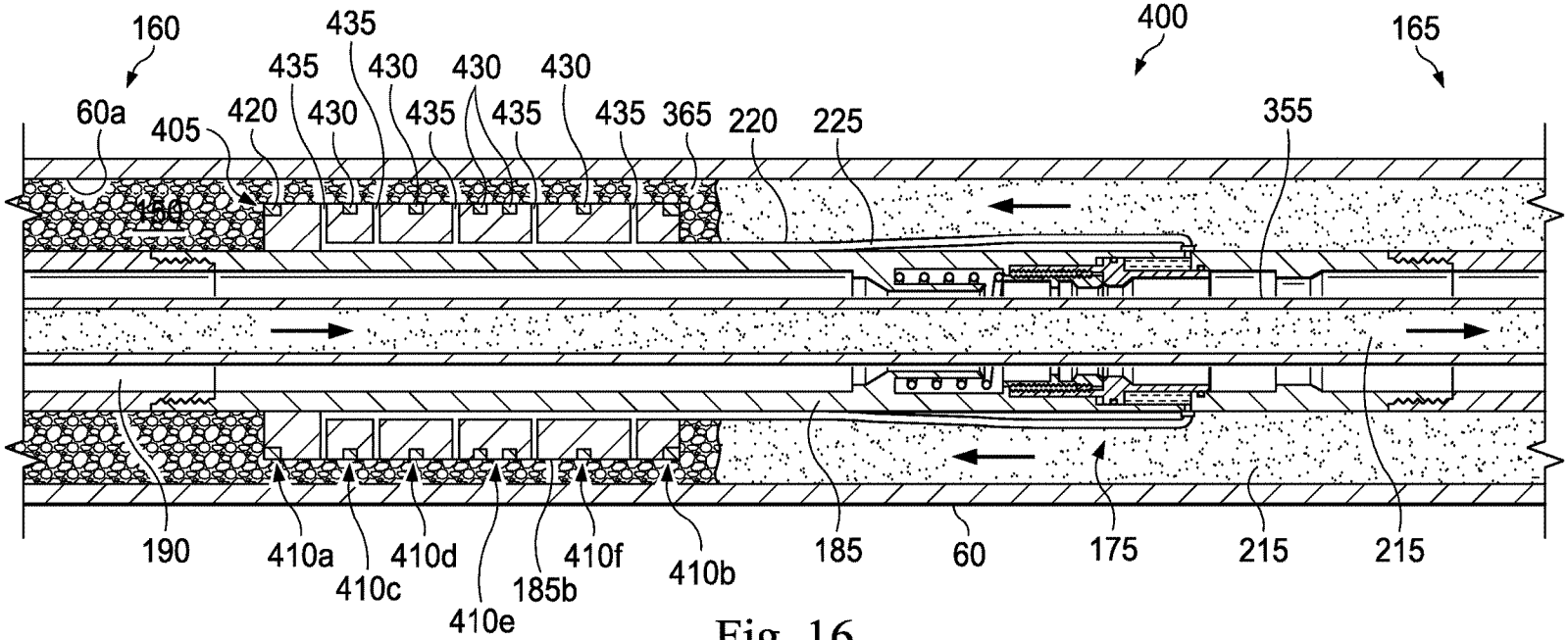
FIG. 16 illustrates a side view of the packer assembly of FIG. 15, according to an exemplary embodiment of the present disclosure.

In another exemplary embodiment and as shown in FIGS. 15 and 16, another embodiment of a packer assembly is generally referred to by the reference number 400, and is similar to the packer assembly 95 depicted in FIGS. 1-10 and contains several parts of the packer assembly 95, which are given the same reference numerals. As shown in FIGS. 15 and 16, the swell packer 170 is omitted in favor of an injection packer 405, which is formed around the base pipe 185 and defined in the longitudinal direction by circumferentially extending magnetic sections 410*a* and 410*b*. The remainder of the components of the packer assembly 400 are substantially identical to the components of the packer assembly 95 and will not be described in further detail. Additional magnetic sections 410*c*, 410*d*, 410*e*, and 410*f* are located between the magnetic sections 410*a* and 410*b* in the longitudinal direction. In one or more embodiments, each of the magnetic sections 410*a* and 410*f* include a ring magnet 420 and 425, respectively, attached to the base pipe 185. The ring magnets 420 and 425 may be o-ring magnets or c-ring magnets. In one or more embodiments, the magnetic sections 410*b*, 410*c*, 410*d*, and 410*e* include multiple magnets 430 that are circumferentially spaced around the exterior surface 185*b* of the base pipe 185. In one or more embodiments, the magnets 430 may be varied in size and shape. In one or more embodiments, the magnets 430 may form a variety of patterns and/or arrays. In one or more embodiments, the magnets 420, 425, and 430 are attached to the base pipe 185 in a variety of ways. For example, grooves (not shown) may be formed in the exterior surface 185 of the base pipe 185 so that each of the magnets 420 and 425 may be fitted within the grooves, respectively. Additionally, a hole or slot may be drilled into the exterior surface 185*b* of the base pipe 185 to accommodate one of the magnets 430. In one or more embodiments, the magnets 420, 425, and 430 may be glued, bonded, screwed, friction fitted, etc. to the base pipe 185. Thus, the disclosure is not limited to a particular configuration for mounting or attaching the magnets 420, 425, and 430 to the base pipe 185. In one or more embodiments, each of the control lines 220 extends within a portion of the base pipe 185 that forms the injection packer 405 and connects to respective ports 435 formed within the exterior surface 185*b* of the base pipe 185 that forms the injection packer 405. In one or more embodiments, the ports 435 are drill holes that extend from the exterior surface 185*b* to the control lines 220. The ports 435 may be circumferentially spaced about the injection packer 405 to distribute the fluid 235 around the exterior surface of the injection packer 405. The ports 435 may also be longitudinally spaced along the injection packer 405 to distribute the fluid 235 along the length of the injection packer 405. In one or more embodiments, the diameter of the ports 435 increase as the distance from the injection assembly 175 increases. That is, the diameter of the ports 435 vary to evenly distribute the fluid 235 along the length of the injection packer 405. In one or more embodiments, the outer diameter of the injection packer 405 is a function of the volume of fluid 235 required to fluidically isolate the third zone 165 from the second zone 160.

Figure 17:
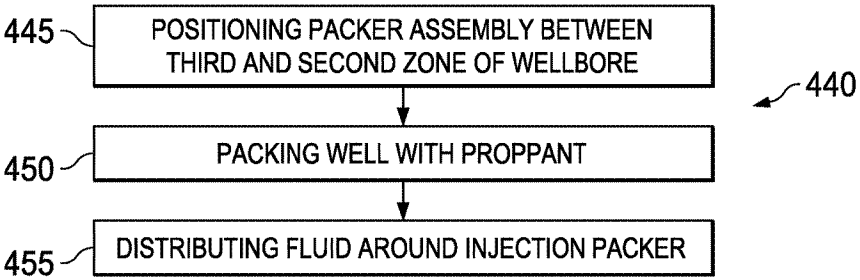
FIG. 17 is a flow chart illustration of a method of operating the apparatus of FIG. 16, according to an exemplary embodiment of the present disclosure.

In an exemplary embodiment and as illustrated in FIG. 17 with continuing reference to FIGS. 1-16, a method 440 of operating the packer assembly 400 includes positioning a packer assembly, such as the packer assembly 400 between adjacent production zones, such as between the third zone 165 and the second zone 160, at step 445, packing the well with proppant 365 at step 450, and distributing the fluid 235 around the injection packer 405 to isolate the third zone 165 from the second zone 160 at step 455.

In one or more embodiments, the packer assembly 400 is positioned within the wellbore 55 at a location between adjacent zones, such as between the third zone 165 and the second zone 160 at the step 445. In one or more embodiments, positioning the packer assembly 400 at a location between the third zone 165 and the second zone 160 at the step 445 is substantially similar to the positioning of the packer assembly 95 at a location between the third zone 165 and the second zone 160 at the step 340, and will not be discussed in further detail.

In one or more embodiments, the well is packed with proppant 365 at the step 450. Similar to the step 350, the proppant 365 "falls" through the annulus 150 of the third zone 165 to the annulus 150 of the second zone 160. In one or more embodiments, the slurry 215 passes over the outer surface of the injection packer 405 when passing from the third zone 165 to the second zone 160. That is, the outer surface of the injection packer 405 and the interior surface 60*a* of the casing string 60 or the inner surface of the wellbore 55 do not form a liquid-tight relationship at the step 450 and the slurry 215 passes between the outer surface of the injection packer 405 and the interior surface 60*a* of the casing string 60 or the inner surface of the wellbore 55. Accordingly, the proppant 365 is packed between the exterior surface of the injection packer 405 and the interior surface 60*a* of the casing string 60 or the inner surface of the wellbore 55. After the well is packed, pumping operations are completed and any fluid inside the annulus may become static or near static.

In one or more embodiments, the fluid 235 is distributed around the injection packer 405 at the step 455. After the fluid inside the annulus 150 is static or near static, the inner tubing 355 may be removed from the well. Similarly to the step 355, the shifting tool 360 activates the spring 310, which pressurizes the fluid chamber 237 to inject the fluid 235 into the control lines 220. In one or more embodiments, the fluid 235 includes the ferrofluid 390. The fluid 235 flows through the control lines 220 and the ports 435 to distribute the fluid 235 around the injection packer 405. The fluid 235 is generally bound in the radial direction between the exterior surface 185*b* of the base pipe 185 that forms the injection packer 405 and the interior surface 60*a* of the casing string 60 or the inner surface of the wellbore 55. In one or more embodiments, the fluid 235, which includes the ferrofluid 390, is bound in the longitudinal direction between any two of the magnetic sections 410*a*, 410*b*, 410*c*, 410*d*, 410*e*, and 410*f*. For example, the ferrofluid 390 within the fluid 235 that passes through the ports 435 located between the magnetic sections 410*a* and 410*c* would be drawn to either the magnet 420 or the magnets 430 that form the magnetic section 410*c*. Thus in one or more embodiments, the ferrofluid 390 creates a generally circumferentially extending liquid barrier to trap the fluid 235 between the magnetic sections 410*a* and 410*c*. The fluid 235 then fills any voids in the proppant 365 located between the injection packer 405 interior surface 60*a* of the casing string 60 or the inner surface of the wellbore 55 to fluidically seal the third zone 165 from the second zone 160. The fluid 235 hardens or cures to permanently seal the third zone 165 from the second zone 160.

In one or more embodiments, the method 440 may be used to effectively isolate zones in a "fishhook" well after the well has been packed with the proppant 365. In one or more embodiments, the injection packer 405 provides for even distribution of gravel when a gravel packing operation is performed. In one or more embodiments, the method 440 may be used to create a liquid-tight seal between the annulus 150 associated with the third zone 165 and the annulus 150 associated with the second zone 160 without requiring a swellable or otherwise expanding packer. In one or more embodiments, the method 440 may be used to prevent or resist a production fluid from entering the third zone 165 from the second zone 160 or vice versa. In one or more embodiments, the exterior diameter of the injection packer 405 remains consistent, or does not change, throughout the gravel packing operation. In one or more embodiments, the method 440 may be used to reduce the amount of "stringers" associated with isolating zones in gravel packing operations. In one or more embodiments, the method 440 requires small volumes of the fluids 235 and 390 to isolate zones in gravel packing operations. In one or more embodiments, the volume of the fluids 235 and 390 required for each packer assembly 400 is less than 20 gallons. In one or more embodiments, the volume of the fluids 235 and 390 required for each packer assembly 400 is less than 15 gallons. However, the volume of the fluids 235 and 390 required for each packer assembly 400 varies depending on the exterior diameter of the injection packer 405. That is, more of the fluids 235 and 390 are required as the exterior diameter of the injection packer 405 is reduced. Generally, the larger the exterior diameter of the injection packer 405, the less of the fluids 235 and 390 required. A variety of combinations involving different exterior diameters of the injection packer 405 and the volume of the fluids 235 and 390 are contemplated here. In one or more embodiments, the method 440 allows for a wider variety of materials to be used as the fluids 235 and 390 due to the reduced volume required and the precise disbursement of the fluids 235 and 390 around the injection packer 405.

Figure 18:
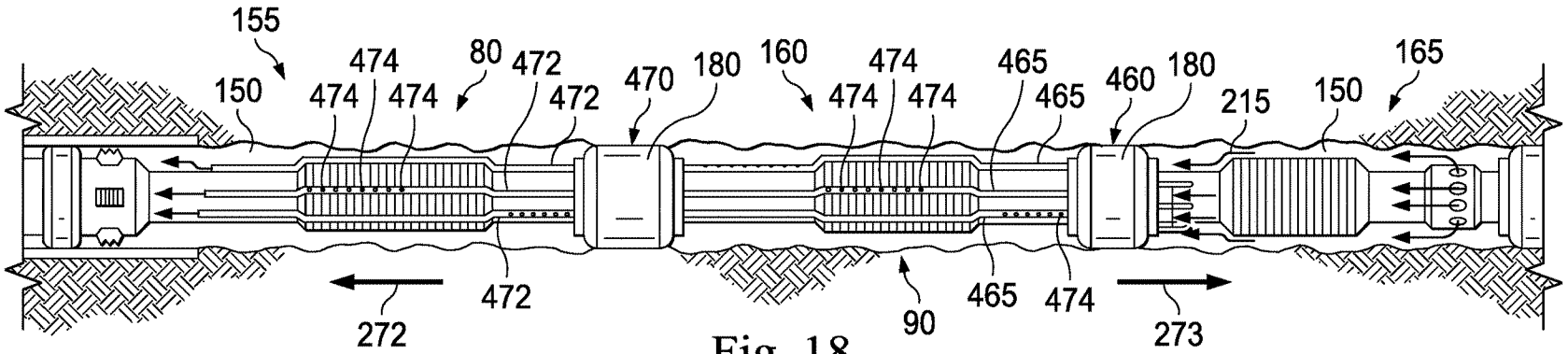
FIG. 18 is a side view of the packer assembly of FIG. 2, according to yet another exemplary embodiment of the present disclosure.

In another exemplary embodiment and as shown in FIG. 18, another embodiment of a packer assembly is generally referred to by the reference number 460, and is similar to the packer assembly 95 depicted in FIGS. 1-10 and contains several parts of the packer assembly 95, which are given the same reference numerals. In one or more embodiments, the shunt tubes 465 of the packer assembly 460 are similar to the shunt tubes 205 of the packer assembly 95 except the shunt tubes 465 extend beyond the seal element 180 in the direction indicated by the arrow 272. The slurry 215 enters the shunt tubes 465 from the annulus 150 in the third zone 165 and flows through the flow bypasses 210 (not shown in FIG. 18). The slurry 215 may continue to pass through the shunt tubes 465 through the annulus 150 in the second zone 160 and over a screen associated with the flow regulating system 90. The shunt tubes 465 extend toward a packer assembly 470, which is similar to the packer assembly 95 depicted in FIGS. 1-10 and contains several parts of the packer assembly 95, which are given the same reference numerals. In one or more embodiments, the packer assembly 470 has shunt tubes 472 that are similar to the shunt tubes 205 in the packer assembly 95 except that the shunt tubes 472 couple to the shunt tubes 465 that extend from the packer assembly 460 so that the slurry 215 may flow from the shunt tubes 465 and into the shunt tubes 470. In one or more embodiments, the shunt tubes 472 extend past the seal element 180 of the packer assembly 470 in the direction indicated by the arrow 273 and the direction indicated by the arrow 272 over a screen associated with the flow regulating system 80, which is in the first zone 155. In one or more embodiments, the packer assembly 470 fluidically seals the annulus 150 associated with the second zone 160 from the annulus 150 associated with the first zone 155. In one or more embodiments, each of the shunt tubes 465 and 472 has perforations 474 that allow the slurry 215 to exit the shunt tubes 465 and 472. Generally, the slurry 215 flows through the shunt tubes 465 and 472 without exiting through the perforations 474 until a portion of the shunt tubes 465 and 472 become packed with the proppant 365, at which time the slurry 315 exits the perforations 474 to pack the annulus 150. A method of operating the packer assembly 465 is similar to the method 335 except that the packer assembly 465 is used in place of the packer assembly 95.

Figure 19:
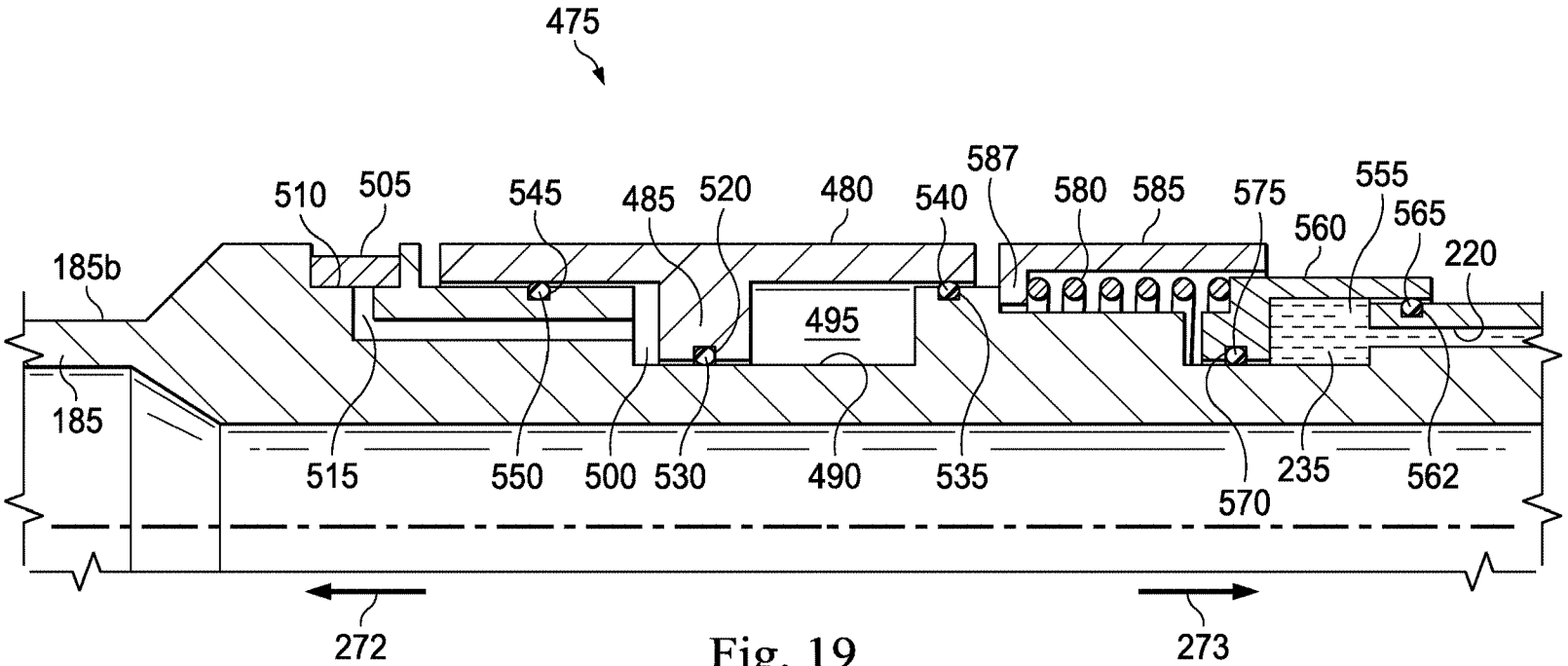
FIG. 19 is a sectional view of the injection assembly of FIG. 2, according to another exemplary embodiment of the present disclosure.

In another exemplary embodiment and as shown in FIG. 19, the injection assembly 175 is omitted from the packer assembly 95 and the control lines 220 are fluidically coupled to a hydrostatic injection assembly 475. In one or more embodiments, the injection assembly 475 includes a balance piston 480 concentrically disposed about the exterior surface 185*b* of the base pipe 185. The balance piston 480 forms an inwardly extending lip 485 that is accommodated in an indentation 490 formed within the exterior surface 185*b* of the base pipe 185 to define a pressure chamber 495 in the direction indicated by the arrow 273 and a pressure chamber 500 in the direction indicated by the arrow 272. Movement of the lip 485 in the direction indicated by the arrow 273 decreases the volume of the pressure chamber 495 while increasing the volume of the pressure chamber 500. While in an initial state, each of the pressure chambers 495 and 500 store a gas, such air, that is trapped in the pressure chambers 495 and 500 during assembly of the injection assembly 475. A burst disk 505 may be sealingly attached to the base pipe 185 within a recess 510 formed within the base pipe 185. The burst disk 505 extends over a fluid passage 515, or drill hole, which is fluidically coupled to the pressure chamber 500. A groove 520 is formed within the interior surface of the lip 485 to accommodate a sealing element 530, such as an o-ring, to sealingly engage the base pipe 185 and a groove 535 is formed within the exterior surface 185*b* of the base pipe 185 to accommodate a sealing element 540, such as an o-ring, that sealingly engages the balance piston 480. Together, the sealing elements 530 and 540 seal the pressure chamber 495. A groove 545 is formed within the exterior surface 185*b* of the base pipe 185 to accommodate a sealing element 550, such as an o-ring, that sealingly engages the balance piston 480. Together, the sealing elements 530 and 550 seal the pressure chamber 500. The injection assembly 475 also includes a fluid chamber 555 formed between the base pipe 185 and a piston 560. Movement of the piston 560 in the direction indicated by the arrow 273 reduces the volume of the fluid chamber 555 and causes the fluid 235 to exit the fluid chamber 555 via the controls lines 220 that are fluidically coupled to the fluid chamber 555. A groove 562 is formed within the exterior surface 185*b* of the base pipe 185 to accommodate a sealing element 565, such as an o-ring, that sealingly engages the piston 560 and a groove 570 is formed within the piston 560 to accommodate a sealing element 575, such as an o-ring. Together, the sealing elements 565 and 575 seal the fluid chamber 555. A spring 580 may be disposed longitudinally between the balance piston 480 and the piston 560. A spring housing 585 may be concentrically disposed about the exterior surface of the spring 580 and has an inwardly extending lip 587 that extends between an end of the spring 580 and the balance piston 480. Generally, movement of the balance piston 480 in the direction indicated by the arrow 273 causes the balance piston 480 to contact the spring housing 585 and moves the spring housing 585 in the direction indicated by the arrow 273, which energizes the spring 580. In one or more embodiments, the spring 580 is in contact with the piston 560 such that energizing the spring 580 can move the piston 560 in the direction indicated by the arrow 273 to pressurize the fluid chamber 555.

In one or more embodiments, and before the packer assembly 95 is placed downhole, the fluid 235 is placed or loaded within the fluid chamber 555. Additionally, the pressure chambers 495 and 500 may be filled with a gas under atmospheric pressure conditions, such as under 14 psi. In one or more embodiments, the burst disk 505 is in an initial condition when the packer assembly 95 is placed downhole, such that the burst disk 505 has not ruptured and thus, seals the fluid passage 515. In one or more embodiments, and at the step 355 or 455, the burst disk 505 ruptures or bursts once the pressure exerted on the burst disk 505 reaches a predetermined pressure, such as for example, 10,000 psi or 20,000 psi. Once the burst disk 505 is in the ruptured condition (i.e., has ruptured) the fluid in the annulus 150 may enter the fluid passage 515. Generally, the rupture of the burst disk 505 increases the pressure within the pressure chamber 500 such that the balance piston 480 moves in the direction indicated by the arrow 273. Movement of the balance piston 480 in the direction indicated by the arrow 273 causes the balance piston 480 to contact the spring housing 585, which then energizes the spring 580 to push the piston 560 in the direction indicated by the arrow 273. That is, movement of the balance piston 480 may be due to a hydrostatic pressure within the wellbore 55 and the energizing of the spring 580 may be a function of the hydrostatic pressure. This movement of the piston 560 pressurizes the fluid chamber 555 to cause the fluid 235 to exit the fluid chamber 555 via the control lines 220. In one or more embodiments, one or more crush sleeves (not shown) is concentrically disposed about the exterior surface 185*b* of the base pipe 185 to prevent over pressurization of the fluid 235 during the step 355 or 455. For example, a crush sleeve may be disposed longitudinally between the balance piston 480 and the spring housing 585.

In another exemplary embodiment, the injection assembly 175 is omitted and the control lines 220 are fluidically coupled to an electric injection assembly (not shown). In one or more embodiments, the electric injection assembly is coupled to the electric cable 145. In one or more embodiments, the electric injection assembly includes a fluid reservoir configured to accommodate the fluid 235, a pump in fluid communication with the fluid reservoir and the control lines 220, and a pump controller in control of the pump and powered by the electric cable 145. In one or more embodiments, the pump controller communicates with a controller located at the surface of the well or at another location downhole. In one or more embodiments, the pump controller sends data relating to the status of the pump and an output pressure to the surface of the well. In one or more embodiments, the controller located at the surface of the well controls the pump controller to initiate the step 355 or 455. In one or more embodiments, the pump is preprogrammed at the surface of the well to initiate the step 355 or 455 at a specific downhole pressure.

In one or more embodiments, the bursting disk 505 can be any type of mechanism that allows fluid to pass at a predetermined pressure. That is, the bursting disk 505 includes any pressure triggered valve or mechanism. In one or more embodiments, any sealing element may be used in place of o-rings.

In one or more embodiments, instead of using the ferrofluid 390, the fluid 235 could include small magnetic particles that would attach themselves to the magnets 385, 420, 425, and/or 430 to block or at least resist a portion of the fluid 235 from exiting an area (i.e., the fluid bypasses 210, the area between sections 410*a* and 410*b*, etc.).

Thus, a completion assembly has been described. Embodiments of the completion assembly may generally include a packer assembly and an injection assembly. For any of the foregoing embodiments, the completion assembly may include any one of the following elements, alone or in combination with each other:

- The packer assembly includes an elongated base pipe, a seal element disposed on the base pipe, the seal element having a first end and a second end and an inner surface and an outer surface; and a shunt tube extending from at least the first end to the second end of the seal element and radially inward of the outer surface.
- The injection assembly includes a fluid chamber with a setting fluid disposed therein; and a fluid control line having a first end fluidically coupled to the fluid chamber and a second end that extends to a location in proximity to the shunt tube
- The seal element is a shunt tube packer.
- The seal element is an annular packer.
- The packer assembly further comprises a magnetized material disposed on the shunt tube; and a ferrofluid is disposed within the fluid chamber.
- A piston sleeve movable along the longitudinal axis of the base pipe at least partially forms the fluid chamber; and the injection assembly further comprises a spring coupled to the base pipe at a location in proximity to the piston sleeve.
- A piston sleeve movable along the longitudinal axis of the base pipe partially forms the fluid chamber; and the injection assembly further comprises a burst disk coupled to the base pipe at a location in proximity to the piston sleeve.
- The injection assembly further comprises a pump disposed at a location in proximity to the fluid chamber.

The packer assembly includes an elongated base pipe; and a magnetized material disposed on the elongated based pipe.

The injection assembly includes a fluid chamber with a setting fluid and a ferrofluid disposed therein; and a fluid control line having a first end fluidically coupled to the fluid chamber and a second end that extends to a location in proximity to the magnetized material.

Thus, a completion method has been described. Embodiments of the completion method may generally include positioning a completion assembly between a first zone and a second zone of a wellbore, packing the wellbore with proppant, and providing a setting fluid at a location in proximity to the packer assembly to fluidically seal the first zone from the second zone. In other embodiments, a completion method may generally include disposing a setting fluid in a fluid chamber that is at least partially formed within a base pipe that forms an annulus within the wellbore, positioning a packer that extends along the base pipe to a position between a first zone and a second zone; packing at least a portion of the annulus that extends along a length of the packer with proppant;

actuating an injection assembly that is coupled to the fluid chamber to fill the portion of the annulus with the setting fluid; and hardening the setting fluid to block the portion of the annulus to fluidically isolate the first zone from the second zone. For any of the foregoing embodiments, the method may include any one of the following, alone or in combination with each other:

The injection assembly includes a fluid chamber with a setting fluid disposed therein; and a fluid control line having a first end fluidically coupled to the fluid chamber and a second end that extends to a location in proximity to the packer assembly.

The packer assembly includes an elongated base pipe; a seal element disposed on the base pipe, the seal element having a first end and a second end and an inner surface and an outer surface; and a shunt tube extending from at least the first end to the second end of the seal element and radially inward of the outer surface.

The second end of the fluid control lines extends to a location in proximity to the shunt tube.

Actuating the seal element.

Packing the wellbore with proppant includes passing proppant through the shunt tube.

Forcing the setting fluid from the fluid chamber and out the second end includes forcing the setting fluid into a portion of the shunt tube.

The seal element is a shunt tube packer or an annular packer.

The packer assembly further includes a magnetized material disposed on the shunt tube; a ferrofluid is disposed within the fluid chamber.

Forcing the ferrofluid into a portion of the shunt tube.

Forcing the setting fluid from the fluid chamber and out the second end includes energizing a spring that is located in proximity to a piston sleeve that at least partially forms the fluid chamber; and moving the piston sleeve, using the energized spring, to reduce the volume of the fluid chamber.

Forcing the setting fluid from the fluid chamber and out the second end includes pumping the setting fluid out the fluid chamber.

to the packer assembly includes an elongated base pipe; a magnetized material disposed on the elongated based pipe; and a ferrofluid is disposed in the fluid chamber.

Forcing the setting fluid from the fluid chamber and out the second end includes forcing the ferrofluid and the setting fluid to a location in proximity to the magnetized material.

The shunt tube extends beyond the first end of the seal element.

Actuating the injection assembly includes energizing a spring that is coupled to the base pipe; and moving a piston sleeve that is coupled to the base pipe and that at least partially forms the fluid chamber, using the spring, to pressurize the fluid chamber.

Pressurizing the fluid chamber forces the setting fluid from the fluid chamber and into the portion of the annulus.

Energizing the spring is a function of a hydrostatic pressure within the wellbore.

Positioning magnetized materials along the length of the packer, accommodating a ferrofluid within the fluid chamber; and actuating the injection assembly to fill at least a portion of the passage with the ferrofluid.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A completion assembly comprising:

a packer assembly comprising:

an elongated base pipe;

a seal element disposed on the base pipe, the seal element having a first end and a second end and an inner surface and an outer surface; and a shunt tube extending from at least the first end to the second end of the seal element and radially inward of the outer surface; and an injection assembly comprising:

a fluid chamber with a setting fluid disposed therein; and a fluid control line having a first end fluidically coupled to the fluid chamber and a second end that extends to a location in proximity to the shunt tube;

wherein (i) a piston sleeve movable along the longitudinal axis of the base pipe at least partially forms the fluid chamber, and the injection assembly further comprises a spring coupled to the base pipe at a location in proximity to the piston sleeve; or (ii) the injection assembly further comprises a pump disposed at a location in proximity to the fluid chamber.

2. The completion assembly defined in claim 1, wherein the seal element is a shunt tube packer.

3. The completion assembly defined in claim 1, wherein the seal element is an annular packer.

4. The completion assembly as defined in claim 1, wherein the packer assembly further comprises a magnetized material disposed on the shunt tube; and wherein a ferrofluid is disposed within the fluid chamber.

5. A completion assembly comprising:
a packer assembly comprising:
an elongated base pipe; and
a magnetized material disposed on the elongated based pipe; and
an injection assembly comprising:
a fluid chamber with a setting fluid and a ferrofluid disposed therein; and
a fluid control line having a first end fluidically coupled to the fluid chamber and a second end that extends to a location in proximity to the magnetized material.

6. The completion assembly as defined in claim 5,
wherein a piston sleeve movable along the longitudinal axis of the base pipe at least partially forms the fluid chamber, and
wherein the injection assembly further comprises a spring coupled to the base pipe at a location in proximity to the piston sleeve.

7. The completion assembly as defined in claim 5,
wherein a piston sleeve movable along the longitudinal axis of the base pipe partially forms the fluid chamber; and
wherein the injection assembly further comprises a burst disk coupled to the base pipe at a location in proximity to the piston sleeve.

8. The completion assembly as defined in claim 5, wherein the injection assembly further comprises a pump disposed at a location in proximity to the fluid chamber.

9. A completion method comprising:
positioning a completion assembly between adjacent first and second zones of a wellbore, the completion assembly comprising:
a packer assembly; and
an injection assembly comprising:
a fluid chamber with a setting fluid disposed therein; and
a fluid control line having a first end fluidically coupled to the fluid chamber and a second end that extends to a location in proximity to the packer assembly;
packing the wellbore with proppant; and
forcing the setting fluid from the fluid chamber and out the second end;
wherein forcing the setting fluid from the fluid chamber and out the second end comprises:
(i) energizing a spring that is located in proximity to a piston sleeve that at least partially forms the fluid chamber, and moving the piston sleeve, using the energized spring, to reduce the volume of the fluid chamber; or
(ii) pumping the setting fluid out the fluid chamber.

10. The completion method of claim 9,
wherein the packer assembly comprises:
an elongated base pipe;
a seal element disposed on the base pipe, the seal element having a first end and a second end and an inner surface and an outer surface; and
a shunt tube extending from at least the first end to the second end of the seal element and radially inward of the outer surface;
wherein the second end of the fluid control lines extends to a location in proximity to the shunt tube;
wherein the method further comprises actuating the seal element;
wherein packing the wellbore with proppant comprises passing proppant through the shunt tube; and
wherein forcing the setting fluid from the fluid chamber and out the second end comprises forcing the setting fluid into a portion of the shunt tube.

11. The completion method of claim 10, wherein the seal element is a shunt tube packer or an annular packer.

12. The completion method of claim 10,
wherein the packer assembly further comprises a magnetized material disposed on the shunt tube;
wherein a ferrofluid is disposed within the fluid chamber; and
wherein the method further comprises forcing the ferrofluid into a portion of the shunt tube.

13. The completion method of claim 10,
wherein the packer assembly comprises:
an elongated base pipe; and
a magnetized material disposed on the elongated based pipe;
wherein a ferrofluid is disposed in the fluid chamber;
wherein forcing the setting fluid from the fluid chamber and out the second end comprises forcing the ferrofluid and the setting fluid to a location in proximity to the magnetized material.

14. The completion method of claim 10, wherein the shunt tube extends beyond the first end of the seal element.

15. The completion method of claim 9, wherein forcing the setting fluid from the fluid chamber and out the second end comprises:
energizing a spring that is located in proximity to a piston sleeve that at least partially forms the fluid chamber, and
is moving the piston sleeve, using the energized spring, to reduce the volume of the fluid chamber; and
wherein energizing the spring is a function of a hydrostatic pressure within the wellbore.

16. A completion method of fluidically isolating a first zone of a wellbore from a second zone of the wellbore, the method comprising:
disposing a setting fluid in a fluid chamber that is at least partially formed within a base pipe that forms an annulus within the wellbore,
positioning a packer that extends along the base pipe to a position between the first zone and the second zone;
packing at least a portion of the annulus that extends along a length of the packer with proppant;
actuating an injection assembly that is coupled to the fluid chamber to fill the portion of the annulus with the setting fluid; and
hardening the setting fluid to block the portion of the annulus to fluidically isolate the first zone from the second zone.

17. The completion method of claim 16, wherein actuating the injection assembly comprises:
energizing a spring that is coupled to the base pipe; and
moving a piston sleeve that is coupled to the base pipe and that at least partially forms the fluid chamber, using the spring, to pressurize the fluid chamber;
wherein pressurizing the fluid chamber forces the setting fluid from the fluid chamber and into the portion of the annulus.

18. The completion method of claim 16, further comprising:
positioning magnetized materials along the length of the packer;
accommodating a ferrofluid within the fluid chamber; and
actuating the injection assembly to fill at least a portion of the passage with the ferrofluid.

* * * * *